US006814015B2

(12) United States Patent
Kouichi

(10) Patent No.: US 6,814,015 B2
(45) Date of Patent: Nov. 9, 2004

(54) LOOPER AND KNIFE DRIVING MECHANISM FOR SEWING MACHINE

(75) Inventor: Sakuma Kouichi, Yamagata (JP)

(73) Assignee: Suzuki Manufacturing, Ltd. (JP)

( * ) Notice: Subject to any disclaimer, the term of this patent is extended or adjusted under 35 U.S.C. 154(b) by 320 days.

(21) Appl. No.: 10/048,935

(22) PCT Filed: Mar. 5, 2001

(86) PCT No.: PCT/JP01/01668

§ 371 (c)(1),
(2), (4) Date: Jun. 10, 2002

(87) PCT Pub. No.: WO02/04731

PCT Pub. Date: Jan. 17, 2002

(65) Prior Publication Data

US 2002/0189516 A1 Dec. 19, 2002

(30) Foreign Application Priority Data

Jul. 7, 2000 (JP) ..... 2000-207348
Sep. 27, 2000 (JP) ..... 2000-294650
Oct. 24, 2000 (JP) ..... 2000-324247

(51) Int. Cl.[7] ..... D05B 57/00; D05B 37/06
(52) U.S. Cl. ..... 112/199; 112/122.1
(58) Field of Search ..... 112/199, 122, 112/122.1, 125, 129, 220, 162, 475.26, 166, 197

(56) References Cited

U.S. PATENT DOCUMENTS 1,613,540 A * 1/1927 Siegel ..... 112/122.1
3,167,042 A * 1/1965 Bono ..... 112/122.1
4,991,525 A * 2/1991 De Santis ..... 112/199
5,427,041 A * 6/1995 Satoma ..... 112/125
5,465,674 A * 11/1995 Gosche ..... 112/162
5,546,878 A * 8/1996 Sakuma ..... 112/162

* cited by examiner

*Primary Examiner*—Ismael Izaguirre
(74) *Attorney, Agent, or Firm*—Lorusso, Loud & Kelly

(57) ABSTRACT

In a looper and cutter drive mechanism for sewing machine, an upper looper and a lower looper are respectively disposed below a throat plate, respective loop-taker points of these loopers are arranged in the same direction such that the loop-taker points pass a front side of the needle as seen in the stitching direction. The upper looper and the lower looper are driven such that the upper looper and the lower looper perform movements having traces on planes substantially parallel to each other. Due to such a constitution, the looper drive mechanism has both of the lockstitching function and the over-edge stitching function and can perform both functions by a single sewing machine. Further, the rotational movement of an upper shaft of the sewing machine is transferred to the upward and downward movement by way of a motion transfer mechanism which is operated in an interlocking manner with the rotational movement and a fabric edge is cut by an upper cutter which is operated corresponding to the upward and downward movement and a lower cutter which is cooperatively operated with the upper cutter. Here, the upper cutter is slidably guided by a cutter drive portion which is pivotally mounted on a frame. The motion transfer mechanism is connected to the upper cutter by way of a clutch. The clutch transfers power to the upper cutter at the time of performing the cutters of the cutter drive portion and pivotally moves the cutter drive portion to a shunting position and interrupts the transmission of power to the upper cutter at the time of not performing the cutters.

13 Claims, 27 Drawing Sheets

(a)

(b)

(a)

(b)

(a)

(b)

LOOPER AND KNIFE DRIVING MECHANISM FOR SEWING MACHINE

TECHNICAL FIELD

The present invention relates to a looper and a cutter drive mechanism for sewing machine, and more particularly to a looper and a cutter drive mechanism for sewing machine which can perform lock stitching and over-edge stitching integrally and further can perform such stitchings by changing over an operation which performs the over-edge stitching in the lock stitching by cutting a fabric edge and an operation which performs the lock stitching without cutting the fabric edge.

BACKGROUND OF THE INVENTION

Conventionally, as the most fundamental stitch formed by a sewing machine among stitches formed by joining a plurality of fabrics or the like, a lock stitching is known. In the lock stitching, when an upper thread which is made to pass through a needle is made to penetrate the fabric along with the vertical movement of the needle, by intercepting the upper thread with a loop-taker point of a rotary hook which accommodates a lower thread so that the upper thread and the lower thread are crossed with each other to form the lock stitching whereby a plurality of fabrics are securely joined along the stitch.

On the other hand, as the stitching which can prevent unraveling of peripheral portions of the fabrics or the like which are liable to be disintegrated, an over-edge stitching is known. In the over-edge stitching, depending on the number of threads for forming the stitch and the number of needles which perform an approximately vertical movement relative to a fabric surface, there have been known a single-needle two-thread over-edge stitching (U.S.A. Stitch standard: Stitch type 503), a single-needle three-thread over-edge stitching (U.S.A. Stitch standard: Stitch type 504), and further a two-needle five-thread stitching (U.S.A. Stitch standard: Stitch type 516) which combines a chain stitching and the over-edge stitching and is usually called an interlock.

However, in such an over-edge stitching, to form stitches, a thread is intercepted from side by two hook-shaped needles called loopers or looper threads which move horizontally are intercepted by needles. In this manner, since the looper threads do not cross in the direction perpendicular to the fabric surface with respect to the needle thread, it is impossible to securely join the fabrics as in the case of the lockstitching. That is, there arises a so-called "laughing" phenomenon in which when two fabrics joined by the over-edge stitching are opened, the stitching threads are exposed outside. Accordingly, in performing the over-edging after joining a plurality of fabrics, it is necessary to form the stitch (U.S.A. Stitch standard: Stitch type 517) by performing the lockstitch.

In such a stitch (U.S.A. Stitch standard: Stitch type 517), although it is desirable that the lockstitch portion and the over-edge portion are disposed as close as possible to each other, the lockstitch requires a rotary hook to accommodate a lower thread below the needle which performs the vertical movement, while the over-edge stitching requires loopers which move to cross a locus of the vertical movement of a needle which is provided separately from the needle of the lockstitching and hence, there naturally exists a limit with respect to the respective positions of the lockstitch portion and the over-edge stitching portion. In view of the above, sewing machines which can be used for both of the lockstitching and the over-edge stitching have been proposed in Japanese Patent Publication 15268/1981, Japanese Patent Publication 25145/1985, Japanese Patent Publication 25396/1986 and the like. However, all of the sewing machines disclosed in these publications are sewing machines which selectively use one of these functions and it has been impossible to perform the lockstitching and the over-edge stitching simultaneously in a state that the lockstitching and the over-edge stitching are disposed close to each other.

On the other hand, methods in which the lockstitching and the over-edge stitching can be performed simultaneously have been proposed as disclosed in Japanese Laid-open Patent Publication 113490/1980, Japanese Laid-open Patent Publication 136085/1980, Japanese Laid-open Patent Publication 146190/1980, Japanese Laid-open Patent Publication 122495/1988 and the like. However in these proposals, with respect to the over-edge stitching, since the loopers which cross the locus of the vertical movement of a needle and are provided separately from the lockstitching adopt the looper movement of the above-mentioned conventional over-edge stitching as their movement, the lockstitching requires a rotary hook to accommodate the lower thread below the needle which performs the vertical movement and the over-edge stitching requires the loopers which performs their movement such that the movement crosses the locus of the vertical movement of the needle provided separately from the lockstitching. Accordingly, there naturally exits a limit with respect to the positions of the over-edge stitching and the lockstitching and it has been difficult to perform the lockstitching and the over-edge stitching simultaneously in a state that the lockstitching and the over-edge stitching are disposed close to each other in terms of the mechanism of the sewing machine.

Further, a lockstitching/over-edge stitching attachment (manufactured by TOYO SEIKI KOGYO KABUSHIKIGAISHA, product name "RUBYLOCK") which simultaneously performs the lockstitching and the over-edge stitching has been proposed (Japanese Patent Publication 2541601). As shown in FIG. 27, this attachment is used in a form that it is fixedly mounted on a fabric presser rod 1001. A drive arm 1003*a* of a crank 1003 journalled in an attachment frame 1002 is driven by a needle rod (not shown in the drawing) which carries a needle 1011. A driven arm 1003*b* rocks an upper looper drive plate 1005 supported on the attachment frame 1002 by way of a drive connection link 1004. Due to the rocking of this upper looper drive plate 1005, an upper looper 1007 supported on the attachment frame 1002 by way of an upper looper drive link 1006 is rocked. On the other hand, due to this rocking of the upper looper drive plate 1005, a pin 1005*a* mounted on the upper looper drive plate 1005 in a protruding manner slides in and along a groove 1008*a* formed in a lower looper drive plate 1008 journalled in the attachment frame 1002 and rocks this lower looper drive plate 1008. Due to this rocking of the lower looper drive plate 1008, a lower looper 1010 journalled in the attachment frame 1002 is rocked by way of a lower looper drive link 1009. In such an attachment structure, since the upper looper 1007 must intersect the needle 1011 on the upper surface of a fabric (not shown in the drawing), the upper looper 1007 is inclined in a left upward direction as seen from the fabric feeding and advancing direction. Further, since the lower looper 1010 must intersect the needle 1011 on the lower surface of the fabric, the lower looper 1010 is inclined in the left downward direction as seen from the fabric feeding and advancing direction. Further, the upper and lower loopers 1007,

1010 are inclined such that the upper and lower loopers 1007, 1010 interloop each other at a side of the fabric end of the fabric.

In the drawing, numeral 1014 indicates a needle stitching portion of the needle 1011, numeral 1012 indicates a thread tension equipment and numeral 1013 indicates a looper thread take-up driven by the lower looper drive plate 1008.

In the attachment having such a constitution, when the needle bar performs the upward and downward movement, the lockstitching is formed by the needle thread (not shown in the drawing) which passes through the needle 1011 and the lower thread (not shown in the drawing) accommodated in a rotary hook (not shown in the drawing). Simultaneously, the drive arm 1003*a* of the crank 1003 is driven by the needle bar and the driven arm 1003*b* rocks the upper looper drive plate 1005 by way of the drive connection link 1004. Due to this rocking of the upper looper drive plate 1005, the upper looper 1007 is rocked by way of the upper looper drive link 1006. Due to this rocking of the upper looper drive plate 1005, the pin 1005*a* which is mounted on the upper looper drive plate 1005 in a protruding manner slides in and along the groove 1008*a* formed in the lower looper drive plate 1008 so as to rock the lower looper drive plate 1008. Due to this rocking of the lower looper drive plate 1008, the lower looper 1010 is rocked by way of the lower looper drive link 1009 so that the over-edge stitching is formed by the upper looper thread and the lower looper thread (not shown in the drawing) which respectively pass through the upper looper 1007 and the lower looper 1010.

However, in such an attachment, since the upper and lower loopers 1007, 1010 are inclined, a high machining technique is required in manufacturing and a technique which maintains accuracy in assembling is also required. Further, since this type of lockstitch sewing machine is used by a general household or a tailor as a user, an operation to exchange a fabric presser of the attachment and to fixedly secure the fabric presser to the fabric presser bar becomes extremely cumbersome and an operation to adjust the positional relationship of the upper looper 1007 and the lower looper 1010 relative to the needle after fixedly securing the attachment becomes also extremely cumbersome. This attachment also suffers from a serious drawback that the over-edge stitching operation must be performed after preliminarily cutting the edge of the fabric to be stitched by the over-edge stitching using scissors.

Accordingly, inventors of the present application have proposed a single-needle four-thread lockstitch/over-edge stitch structure and a method for forming such stitching which have both of the lockstitching function and the over-edge stitching function and can form such a stitch structure at a time using a sewing machine (Japanese Patent Publication 2672097). Users of the lockstitch sewing machines have been strongly desiring the research and the development of a lockstitch sewing machine which can realize the single-needle four-thread lockstitch/over-edge stitch structure and a method for forming such a stitch structure disclosed in the above proposal.

Further, all of the single-needle two-thread over-edge stitching (U.S.A. Stitch standard: Stitch type 503), the single-needle three-thread over-edge stitching (U.S.A. Stitch standard: Stitch type 504), the two-needle five-thread over-edge stitching (U.S.A. Stitch standard: Stitch type 516) and the like employed for forming stitches of over-edge stitching perform an over-edge stitching by cutting a fabric edge with cutters consisting of an upper cutter which performs the upward and downward movement and a lower cutter which is cooperatively operated with the upper cutter.

Here, it is considered that the over-edge stitching can be performed easily even in the locksticing if a zigzag stitching is performed after cutting the fabric edge in a zigzag pattern. Based on such a consideration, a sewing machine which adds a cutter cutting function to the lockstitching has been proposed in Japanese Utility Model Laid-open Application 90056/1982, 90057/1982, Japanese Patent Publication 31950/1983 and the like.

Here, in general, in addition to a request that the lockstitch sewing machine must be manufactured in a compact form, it is desirable that the lockstitch portion and the cutter cutting mechanism portion are disposed as close as possible to each other. However, since the lockstitching requires a rotary hook which accommodates a lower thread below a needle which performs the upward and downward movement, there naturally exists a limit in incorporating the cutter cutting mechanism portion into an existing structural space of the lockstitch sewing machine. In this manner, it has been conventionally difficult to physically realize a lockstitch sewing machine which can perform the lockstitching and the fabric-edge cutting simultaneously and to commertialize such a lockstitch sewing machine due to the mechanism of the sewing machine.

The present invention has been made to overcome these conventional drawbacks and it is an object of the present invention to provide a looper drive mechanism of a sewing machine which has both of lockstitching function and over-edge stitching function and can perform them at a time using a single sewing machine.

Further, it is another object of the present invention to provide a cutter drive mechanism of a sewing machine which can incorporate a cutter cutting mechanism portion into an existing structural space of the sewing machine and can change over an operation to perform the over-edge stitching in the lockstitching by cutting a fabric edge and an operation to perform the lockstitching without cutting the fabric edge.

DISCLOSURE OF THE INVENTION

To achieve such an object, in a looper drive mechanism for sewing machine in which using an upper thread which is made to pass through a needle which performs an upward and downward movement drawing a trace vertically relative to a throat plate and a lower thread accommodated in a rotary hook, the upper thread which is made to pass through the needle performing the reciprocating movement in the vertical direction and passing through a work mounted on the throat plate every one stitch feed of the work is, at the time of elevating the upper thread from a lowermost position of the needle, intercepted by a loop-taker point of the rotary hook which accommodates the lower thread below the throat plate and performs the rotary movement so as to make the upper thread and the lower thread interlace each other thus forming a lockstitch portion made of a stitch parallel to a surface of the work and a stitch perpendicular to the surface of the work, and an over-edge stitch portion is formed by an upper looper thread and a lower looper thread which are respectively made to pass through an upper looper which performs a reciprocating movement drawing a substantially arcuate trace extending above and below the throat plate and intersects the trace of the needle above the throat plate and a lower looper which draws a substantially arcuate trace below the throat plate and intersects the trace of the needle and the trace of the upper looper respectively, the looper drive mechanism for sewing machine further includes a looper drive portion having a constitution in which the upper looper and the lower looper are respectively disposed below the throat plate, respective loop-taker points thereof are arranged in the same direction such that the loop-taker points pass a front side of the needle as seen in the stitching direction, the upper looper and the lower looper are driven such that the upper looper and the lower looper perform movements having traces on planes substantially parallel to each other, the upper looper thread which is made to pass through the upper looper which performs the reciprocating movement drawing the arcuate trace which intersects the trace of the needle above the throat plate and passes through the throat plate is intercepted by the needle descending from an uppermost position when the upper looper is descended from an uppermost position, the lower looper thread which is made to pass through the lower looper which performs the reciprocating movement drawing the trace which intersects the trace of the needle and the trace of the upper looper below the throat plate is intercepted by the descending needle below the throat plate when the lower looper is moved from one end to the other end of the trace, and the lower looper thread is intercepted by the upper looper elevating from the lowermost position when the lower looper is moved to the other end, whereby the upper looper thread and the lower looper thread are interlooped each other at the edge portion of the work and, at the same time, the upper looper thread is interlooped with the lockstitch portion through the upper surface of the work, and the lower looper thread is interlooped with the lockstitch portion through the lower surface of the work thus forming the over-edge stitch portion.

The looper drive portion includes a crank which is mounted on a looper drive shaft driven by a lower drive shaft, a lower looper drive link which is connected to the crank, a lower looper mounting arm for carrying the lower looper which is connected to the lower looper drive link and journalled in a frame, an upper looper mounting arm for carrying the upper looper which is journalled in the frame, and an upper looper drive link which connects the lower looper drive link and the upper looper mounting arm.

The looper drive mechanism of sewing machine includes a clutch which forms the lockstitch portion and the over-edge portion by transmitting power from the lower shaft to the looper drive shaft at the time of forming the over-edge portion, and forms the lockstitch portion by shunting the upper looper at the lowermost position and interrupting the transmission of power from the lower shaft to the looper drive shaft at the time of forming the lockstich portion.

In such a looper drive mechanism of sewing machine, the upper looper and the lower looper are respectively disposed below the throat plate, respective loop-taker points thereof are arranged in the same direction such that the loop-taker points pass a frontal side of the needle as seen in the stitching direction, the upper looper and the lower looper are driven such that the upper looper and the lower looper perform movements having traces on planes substantially parallel to each other, whereby the looper drive mechanism has both of the lockstitching function and the over-edge stitching function and they can be performed simultaneously at a time by a single sewing machine.

Further, the clutch can be changed over such that the clutch forms the lockstitch portion and the over-edge portion by transmitting power from the lower shaft to the looper drive shaft at the time of forming the over-edge portion, and forms the lockstitch portion by shunting the upper looper at the lowermost position and interrupting the transmission of power from the lower shaft to the looper drive shaft at the time of forming the lockstich portion.

Still further, a cutter drive mechanism of sewing machine to achieve the above-mentioned object is a cutter drive mechanism of sewing machine for cutting a fabric edge by an upper cutter which performs upward and downward movement by way of a motion transfer mechanism which is operated with a rotary shaft of the sewing machine in an interlocking manner and a lower cutter which is cooperatively operated with the upper cutter, wherein the cutter drive mechanism of sewing machine includes a cutter drive portion pivotally mounted on a frame and slidably guides the upper cutter, and the motion transfer mechanism is connected to the upper cutter such that by way of a clutch which allows the transmission of power to the upper cutter when the cutter operation of the cutter drive portion is performed and interrupts the transmission of power to the upper cutter by pivotally moving the cutter drive portion to a shunting position at the time of not operating the cutters.

The motion transfer mechanism includes a first quadric crank chain which connects an upper shaft constituted by the rotary shaft and the frame and a second quadric crank chain which uses one link of the first quadric crank chain and a link joint of the frame and adopts a drive portion of the clutch as the other one link.

The clutch includes a pin which is formed on the other one link as a drive portion and an elongated groove formed in the upper cutter for allowing the pin to be fitted thereinto as a driven portion.

The lower cutter is slidably mounted on the cutter drive portion and the lower cutter includes a locating locking-portion which positions the cutter drive portion at a locating recessed-portion of a throat plate relative to a needle stitching position at the time of operating the cutters.

The locating recessed-position of the throat plate is constituted position-adjustably in the rightward and leftward direction such that the stitch width can be changed relative to the needle stitching position.

The lower cutter is slidably mounted on the cutter drive portion and the cutter drive mechanism of sewing machine further includes a cutter-side pressure spring member which biases the upper cutter to the lower cutter.

The lower cutter is slidably mounted on the cutter drive portion and the cutter drive mechanism of sewing machine further includes a locating spring member which biases the locating locking-portion to the locating recessed-portion of the throat plate at the time of performing the cutting operation.

The lower cutter is slidably mounted on the cutter drive portion and the cutter drive mechanism of sewing machine further includes a locating eccentric cam which fits the locating locking-portion into the locating recessed-portion of the throat plate at the time of performing the cutting operation.

The upper cutter is replaceably mounted on the cutter drive portion.

In the cutting drive mechanism having such a constitution, the rotational movement of the rotary shaft of the sewing machine is transferred to the upward and downward movement by way of the motion transfer mechanism which is operated in an interlocking manner with the rotary shaft and the fabric edge is cut by the upper cutter and the lower cutter which cooperates with the upper cutter due to this upward and downward movement. Here, the upper cutter is slidably guided by the cutter drive portion pivotally supported on the frame. The motion transfer mechanism is connected to the upper cutter by way of the clutch. The clutch transmits power to the upper cutter when the cutter operation of the cutter drive portion is performed and interrupts the transmission of the power to the upper cutter by pivotally moving the cutter drive portion to the shunting position when the cutter operation of the cutter drive portion is not performed.

Further, the lower cutter of the cutter drive mechanism of the sewing machine of the present invention is slidably mounted on the cutter drive portion and includes a locating locking-portion which locates the cutter drive portion at the locating recessed-portion of the throat plate relative to the needle stitching position at the time of operating the cutters, and the cutter drive portion includes a locating lever which fits the locating locking-portion into the locating recessed-portion of the throat plate at the time of performing the cutter operation.

In the cutting drive mechanism of the sewing machine having such a constitution, the rotational movement of the rotary shaft of the sewing machine is transferred to the upward and downward movement by way of the motion transfer mechanism which is operated in an interlocking manner with the rotary shaft and the fabric edge is cut by the upper cutter and the lower cutter which cooperates with the upper cutter due to this upward and downward movement. Here, the upper cutter is slidably guided by the cutter drive portion pivotally supported on the frame. The motion transfer mechanism is connected to the upper cutter by way of the clutch.

The clutch transmits power to the upper cutter when the cutter operation of the cutter drive portion is performed and interrupts the transmission of the power to the upper cutter by pivotally moving the cutter drive portion to the shunting position when the cutter operation of the cutter drive portion is not performed. Here, with the use of the locating lever of the cutter drive portion, after the locating locking-portion of the lower cutter is removed from the locating recessed-portion of the throat plate, the cutter drive mechanism can be directly pivotally moved to the shunting position.

BEST MODE FOR CARRYING OUT THE INVENTION

Preferred embodiments in which looper and cutter drive mechanisms of the sewing machine of the present invention are applied to a lockstitch/over-edge stitch sewing machine are explained in conjunction with drawings.

Figure 1:
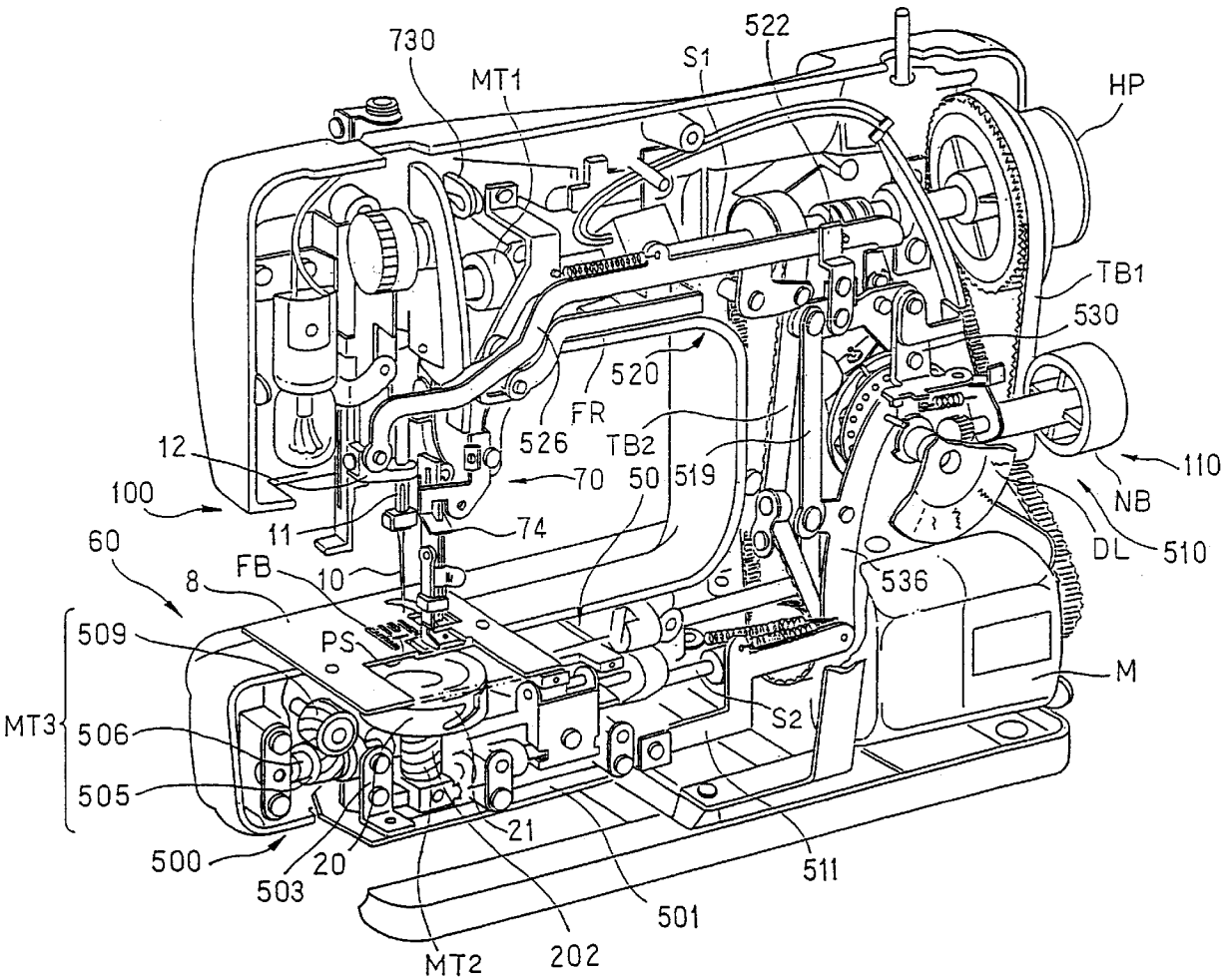
FIG. 1 is an overall perspective view showing one embodiment of a lockstitch/over-edge stitch sewing machine to which a looper drive mechanism of sewing machine of the present invention is applied.

As shown in FIG. 1, the lockstitch/over-edge stitch sewing machine includes a lockstitch forming mechanism 100 which forms a lockstitch portion consisting of a stitch parallel to a surface of a work and a stitch perpendicular to the surface of the work and a looper drive mechanism 50 which forms an over-edge stitch portion on the surface of the work.

Figure 2:
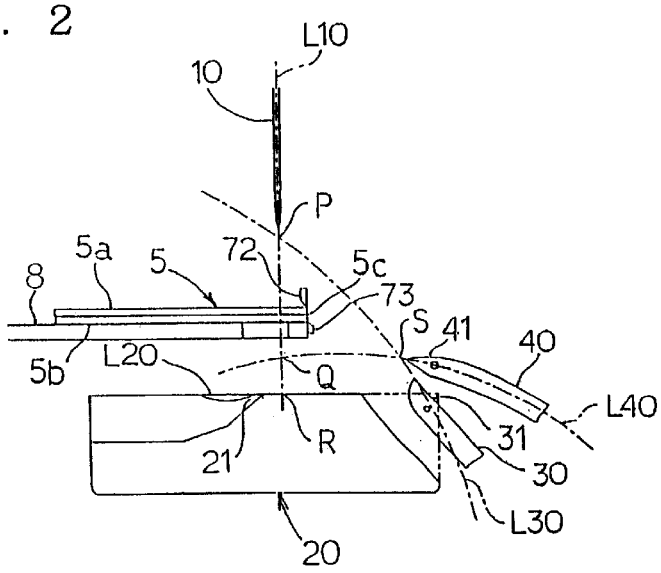
FIG. 2(*a*) and FIG. 2(*b*) are explanatory views simply showing an operation of the lockstitch/over-edge stitch sewing machine to which a looper drive mechanism of sewing machine of the present invention is applied.
Figure 2:
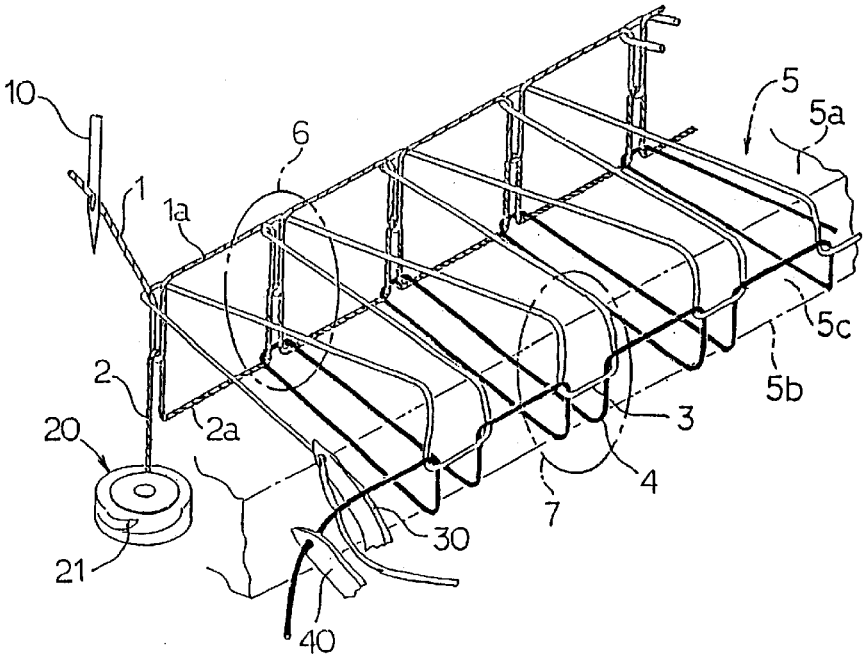

Since this lockstitch forming mechanism 100 has a known (well-known) structure as disclosed in Japanese Laid-open Patent Publication 117148/1974, Japanese Laid-open Patent Publication 154448/1977, Japanese Laid-open Patent Publication 108547/1978, Japanese Laid-open Patent Publication 60052/1979, Japanese Laid-open Patent Publication 110049/1979, Japanese Laid-open Patent Publication 35676/1980, Japanese Laid-open Patent Publication 113490/1980, Japanese Laid-open Patent Publication 146190/1980, Japanese Laid-open Patent Publication 3091/1981 and the like, the detailed explanation of the lockstitch forming mechanism 100 is omitted. However, to simply explain the constitution of the lockstitch forming mechanism, as shown in FIG. 2, the lockstitch forming mechanism 100 includes a needle 10 which is fixedly secured to a needle bar 11 and which performs the upward and downward movement while drawing a trace L10 in a vertical direction relative to a throat plate 8 and a rotary hook 20 which performs a horizontal rotational movement while drawing a trace L20 at the same cycle with the upward and downward movement of the needle 10. Here, the upper thread 1 which is made to pass through the needle 10 capable of performing the reciprocating movement in the vertical direction and passing through a work mounted on the throat plate 8 every one stitch feed of the work is, at the time of elevating the upper thread 1 from a lowermost position of the needle 10, intercepted by a loop-taker point 21 of the rotary hook 20 which accommodates the lower thread 2 below the throat plate 8 so as to make the upper thread 1 and the lower thread 2 interlace each other thus forming a lockstitch portion 6 made of a stitch parallel to a surface of the work and a stitch perpendicular to the surface of the work. The needle bar 11 performs the upward and downward movement by means of a needle bar drive portion MT1 having a needle bar crank which constitutes a motion transfer mechanism vertically slidably supported on a needle frame 12 which has an upper end portion thereof pivotally supported on a frame FR. Further, the rotary hook (loop-taker point) 20 can perform not only the full rotation but also the half rotation. That is, it is sufficient for the rotary hook 20 so long as the trace L20 of the rotary hook 20 can intersect the trace L10 of the needle 10 so that the upper thread 1 can be intercepted by the loop-taker point 21.

Further, as shown in FIG. 1, in the lockstitch/over-edge stitch sewing machine, when a sewing person rotates a stitch changeover knob NB so as to change over a pattern stitch changeover dial DL to various stitch mode corresponding to the rotational positions of the stitch changeover knob NB, a linear stitching, a zigzag stitching and the like can be performed. The lockstitch forming mechanism 100 corresponding to these stitching modes has the known (well-known) structure as disclosed in Japanese Laid-open Patent Publication 50853/1973, Japanese Laid-open Patent Publication 32754/1974, Japanese Laid-open Patent Publication 73754/1975, Japanese Laid-open Patent Publication 4646/1979, Japanese Laid-open Patent Publication 6643/1979, Japanese Laid-open Patent Publication 120057/1979, Japanese Laid-open Patent Publication 16676/1980, Japanese Laid-open Utility Model 216/1980, Japanese Laid-open Utility Model 4787/1980, Japanese Laid-open Utility Model 8406/1980 and the like. For example, the lockstitch forming mechanism 100 has a pattern stitch generating device (not shown in the drawing) or a stitch changeover device 110 which generates the zigzag stitching or the pattern stitching in cooperation with the fabric feeding by moving the needle 10 in the direction perpendicular to the fabric feeding direction every one stitch feed at the time of performing the upward and downward movement. In the lockstitch/over-edge stitch sewing machine shown in FIG. 1, the pattern stitch generating device and the stitch changeover device 110 are integrally formed as a unit, wherein the pattern stitch generating device is incorporated in a rear portion of the stitch changeover device 110.

Figure 3:
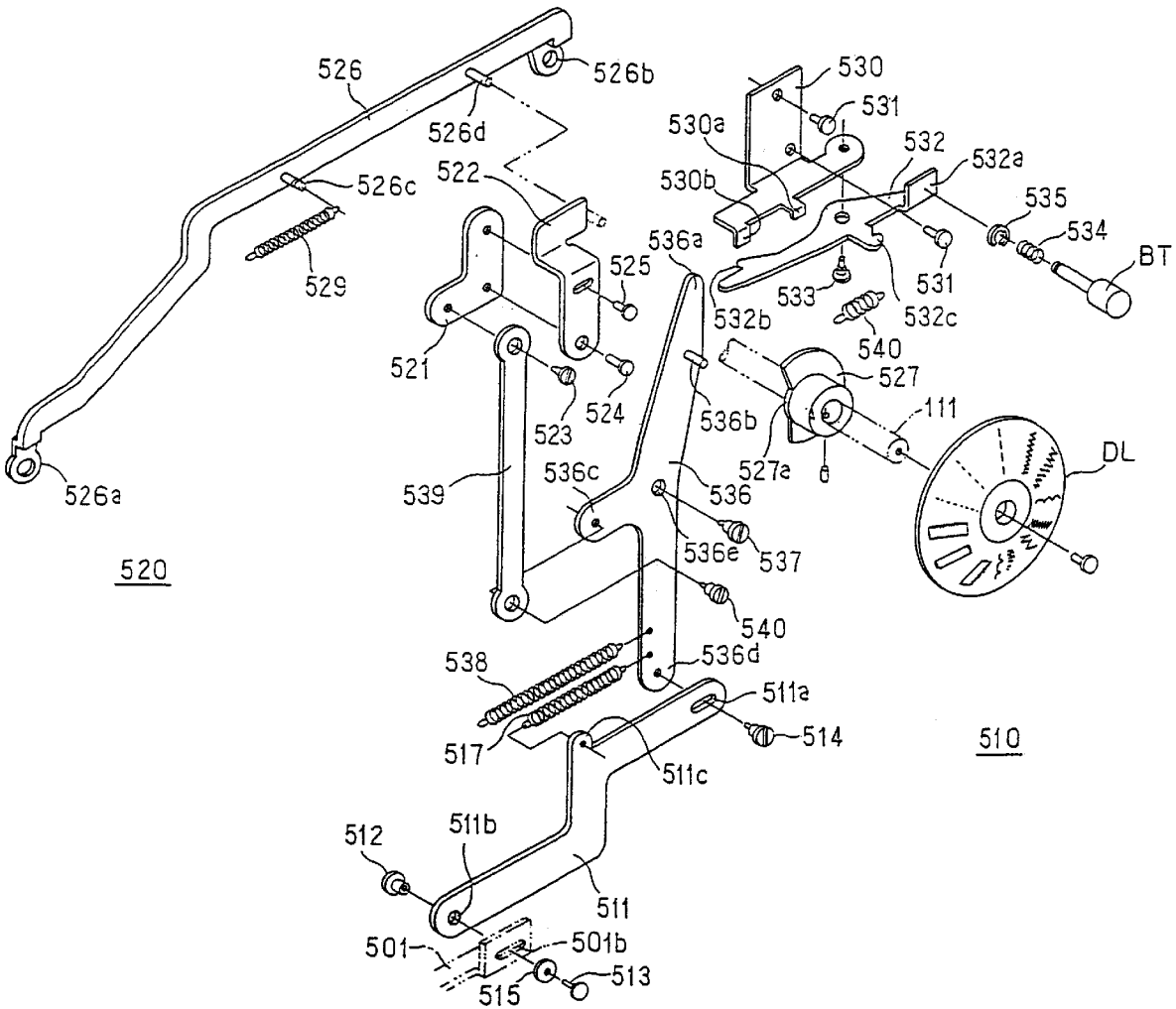
FIG. 3 is an exploded perspective view showing a stitch changeover device, a needle stitching control portion and a crutch control portion in the looper drive mechanism of the sewing machine of the present invention.
Figure 4:
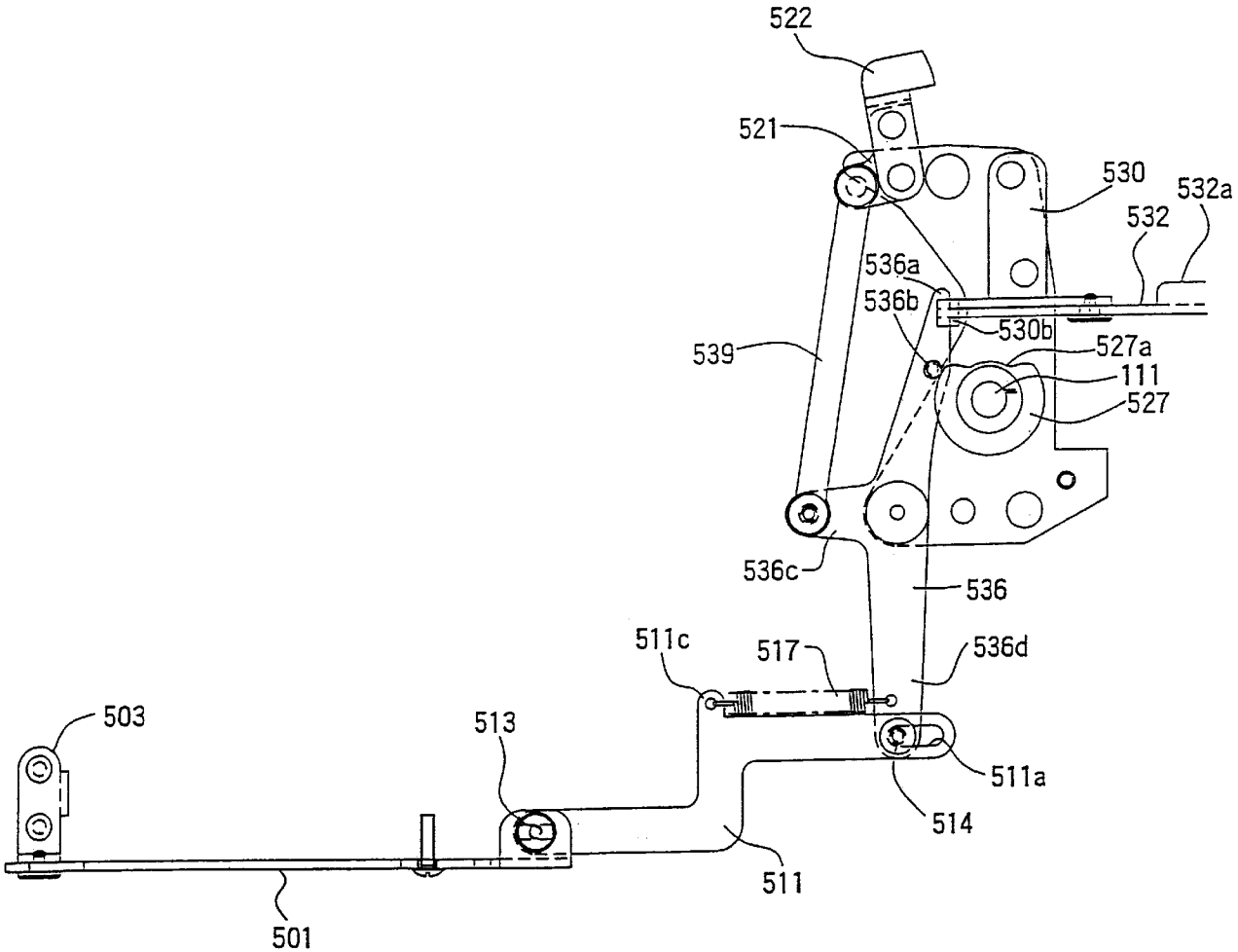
FIG. 4 is an explanatory view showing the needle stitching control portion and the crutch control portion in the looper drive mechanism of the sewing machine of the present invention.

As shown in FIG. 3 and FIG. 4, this stitch changeover device 110 includes a stitch changeover shaft 111 which is rotated by the manipulation of the stitch changeover knob NB and sets a pattern stitches and the pattern stitch changeover dial DL which is fixedly secured to a manipulation-side shaft end of the stitch changeover shaft 111 on which various stitches are displayed. The stitch changeover device 110 is further provided with a mechanism in which when the sewing person selectively changes over the stitch by manipulating the stitch changeover knob NB, a necessary cam is selected from various cams of the pattern stitch generating device and a needle swing quantity, a needle swing position and a needle feed quantity are set.

Further, the pattern stitching generating device and the stitch changeover device 110 perform a drive control of the lockstitch forming mechanism 100 by way of a needle stitching control portion 520. The needle stitching control portion 520 includes a needle-bar pulling bar 526 which has one end thereof connected to the pattern stitch generating device and the other end thereof connected to the needle bar drive portion MT1 of the lockstitch forming mechanism 100 and reciprocally moves the needle bar 11 in the leftward and rightward direction in the needle frame 12 of the needle bar drive portion MT1 due to the drive transmitted from the pattern stitch generating device, a needle stitching transfer cam 527 fixedly secured to the stitch changeover shaft 111 of the stitch changeover device 110 in place, a needle stitching transfer arm 536 which is engaged with the needle stitching transfer cam 527 and is rotatably secured to the frame FR using a stepped screw 537 and a needle stitching transfer pawl 522 which is connected to the needle stitching transfer arm 536 by way of the needle stitching transfer link 539 and is engaged with the needle-bar pulling bar 526.

The needle-bar pulling bar 526 is provided with a spring engaging pin 526*c* in a protruding manner and a tension spring 529 is extended between this spring engaging pin 526*c* and the frame FR. Accordingly, the needle-bar pulling bar 526 is always biased in the left direction as seen from a front view of the sewing machine. Further, the needle-bar pulling bar 526 is provided with a needle stitching transfer pin 526*d* which is engaged with the needle stitching transfer pawl 522 in a protruding manner. The needle stitching transfer pawl 522 which is engaged with the needle stitching transfer pin 526*d* is fixedly secured to a needle stitching adjustment plate 521 by a screw 525. The needle stitching adjustment plate 521 is rotatably connected to one end of the needle stitching transfer link 539 by means of a screw 523. Here, the needle stitching adjustment plate 521 and the needle stitching transfer pawl 522 which are secured by means of the screw 525 are rotatably fixed to the frame FR by means of the screw 524 in an integrated state. The other end of the needle stitching transfer link 539 is rotatably connected by a bolt 540 to an intermediate arm 536*c* formed on the needle stitching transfer arm 536 in a protruding manner toward the needle stitching transfer link 539 in the vicinity of a hole 536*e* which allows a stepped screw 537 to pass therethrough. Further, a security pin 536*b* is formed in protruding manner on an upper side arm 536*a* arranged at an upper portion of the needle stitching transfer arm 536 and this security pin 536*b* is engaged with the needle stitching transfer cam 527. Here, a recessed portion 527*a* is formed in the needle stitching transfer cam 527 so as to allow the security pin 536*b* of the needle stitching transfer arm 536 to enter therein in a protruding manner. Further, a tension spring 538 is extended between a lower side arm 536*d* arranged at a lower portion of the needle stitching transfer arm 536 and the frame FR. Due to such a constitution, when the sewing machine is seen from the front side thereof, the needle stitching transfer arm 536 is resiliently biased in the clockwise direction about the stepped screw 537 as the center so that it becomes possible to make the security pin 536*b* of the needle stitching transfer arm 536 enter the recessed portion 527*a* of the needle stitching transfer cam 527 in a protruding manner.

Further, the needle control portion 520 includes a needle stitching transfer arm holding plate 532 which is operated by an over-edge stitching changeover button BT mounted on a front cover of a sewing machine body (not shown in the drawing) and allows the needle stitching transfer arm 536 to rotate in the clockwise direction when the sewing machine is seen from the front side thereof. The over-edge stitching changeover button BT is always resiliently biased in the direction away from the front cover of the sewing machine body by a compression spring 534. Further, to prevent the over-edge stitching changeover button BT from being disengaged from the front cover of the sewing machine body due to the biasing force of the compression spring 534, the over-edge stitching changeover button BT is engaged with the front cover of the sewing machine body by means of a retainer ring 535 for shaft such that the push manipulation of the over-edge stitching changeover button BT into the front cover of the sewing machine body can be performed. The needle stitching transfer arm holding plate 532 is provided with a receiving portion 532*a* which is to be pressed by a distal end of the over-edge stitching changeover button BT at one end thereof and is provided with a holding portion 532*b* for supporting an end portion of the upper-side arm 536*a* of the needle stitching transfer arm 536. Such a needle stitching transfer arm holding plate 532 is rotatably mounted on a needle by means of a stepped screw 533, while needle stitching transfer arm holding base 530 is fixedly secured to the frame FR by a screw 531. Further, to resiliently bias the needle stitching transfer arm holding plate 532 in the clockwise direction as seen from above, a spring engaging portion 532*c* is formed on the needle stitching transfer arm holding plate 532, a spring engaging portion 530*a* is formed on the needle stitching transfer arm holding base 530, and a tension spring 540 is extended between the spring engaging portion 532*c* and the spring engaging portion 530*a*. Due to such a constitution, a holding portion 532*b* of the needle stitching transfer arm holding plate 532 is brought into pressure contact with an end portion of the upper arm 536*a* of the needle stitching transfer arm 536. Further, the needle stitching transfer arm holding base 530 is provided with a stopper 532*b* which restricts a pushing quantity at the time of manipulating the over-edge stitching changeover button BT. Due to such a constitution, when the pushing manipulation of the over-edge stitching changeover button BT is performed, although the needle stitching transfer arm holding plate 532 is rotated about the stepped screw 533 as the center in the counter-clockwise direction as seen from above, the rotation is restricted by the stopper 530*b* of the needle stitching transfer arm holding base 530 and hence, the restriction of the pushing quantity at the time of manipulating the over-edge stitching changeover button BT can be achieved.

Figure 5:
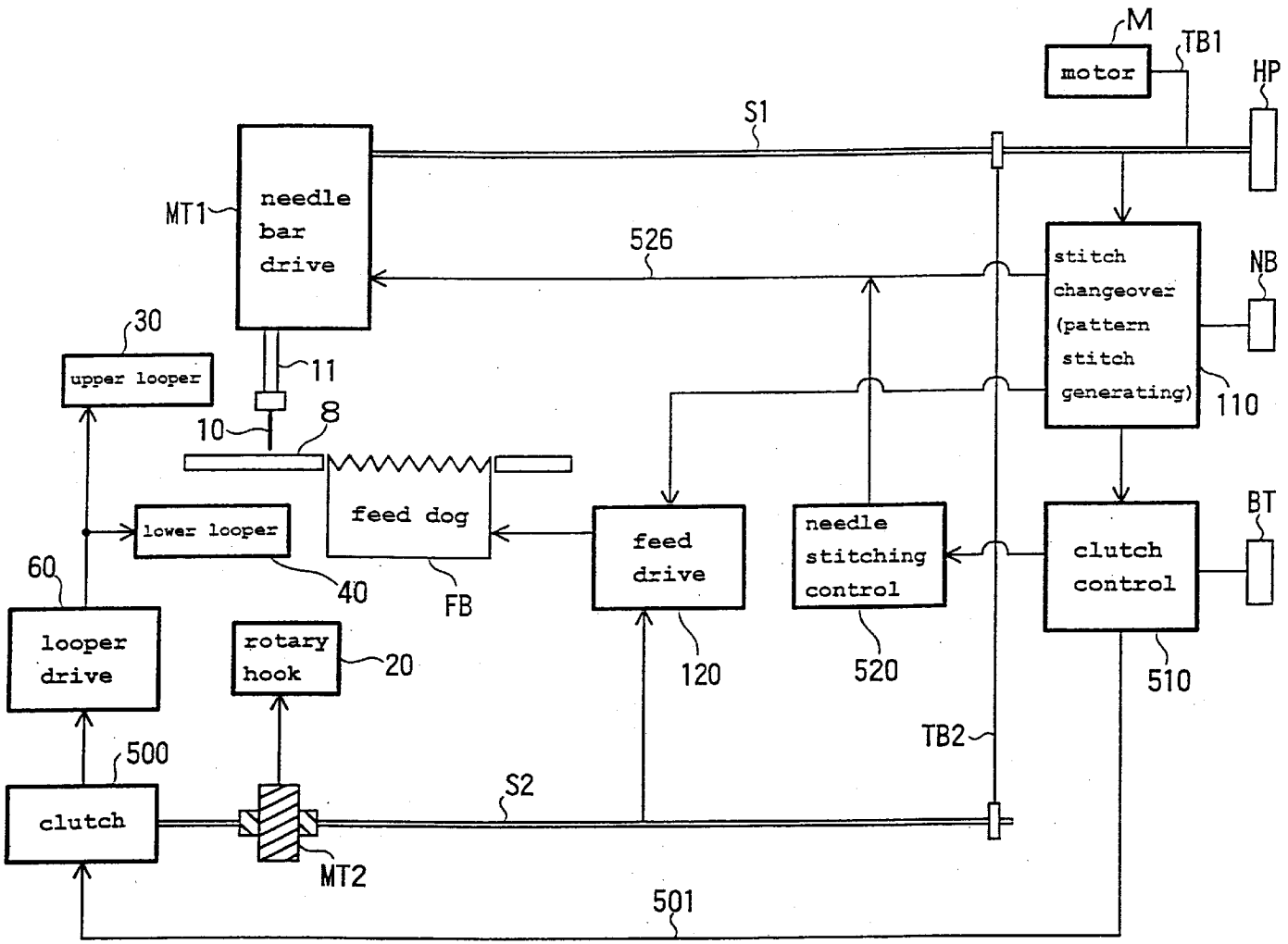
FIG. 5 is a block diagram showing a drive system of the lockstitch/over-edge stitch sewing machine to which a looper drive mechanism of sewing machine of the present invention is applied.

The manner of lockstitch forming operation by the lockstitch forming mechanism 100 having such a constitution is explained in conjunction with FIG. 1 and FIG. 5.

Figure 10:
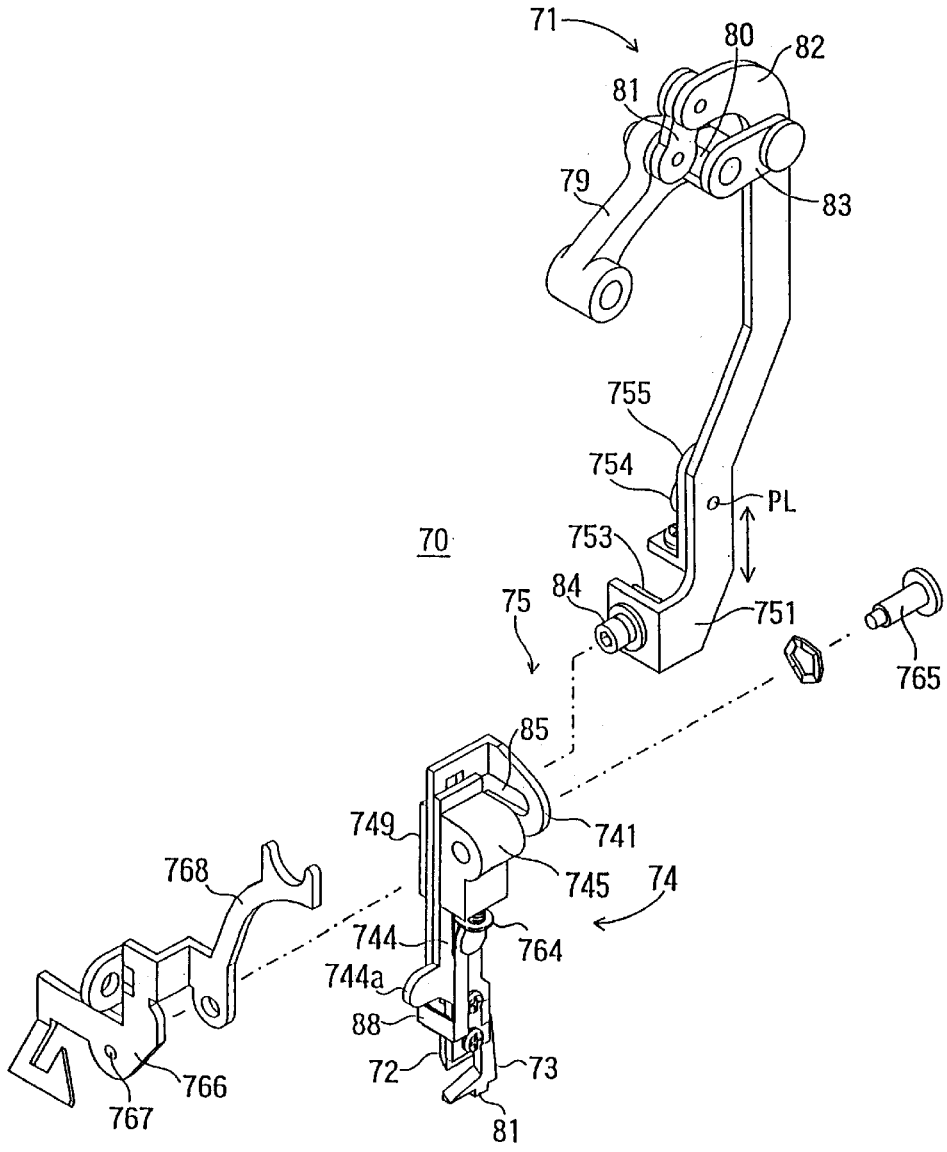
FIG. 10 is a perspective view showing a motion transfer mechanism and a cutter drive portion in the cutter drive mechanism of the sewing machine of the present invention.

The needle 10 performs the upward and downward movement by the power transmitted from the rotary shaft pivotally mounted on the frame FR of the lockstitch/over-edge stitch sewing machine, that is, the upper shaft S1 by way of the needle bar drive portion MT1. Further, the upper shaft S1 performs the upward and downward movement of the needle thread take-up 730 which pulls up or feeds the needle thread by means of a motion transfer mechanism 71 (FIG. 10). This upper shaft S1 is rotatably driven by power transmitted to a hand pulley HP from a motor M by way of a timing belt TB1. Further, the needle frame 12 which slidably supports the needle bar 11 to which the needle 10 is fixedly secured is shifted to the left and right positions every needle by the needle-bar pulling bar 526 which is subjected to a drive control of the pattern stitch generating device. In the throat plate 8, the needle stitching hole PS is formed in a laterally elongated shape such that the needle stitching hole PS allows the shifting of the needle 10 in the left and right positions.

The rotary hook 20 is rotated by power transmitted from a rotary shaft pivotally supported on the frame FR of the lockstitch/over-edge stitch sewing machine, that is, a lower shaft S2 by way of a rotary hook drive screw gear MT2 which constitutes the motion transfer mechanism. The rotary hook drive screw gear MT2 is provided for transmitting the rotational movement from the lower shaft S2 to the rotary hook 20 by converting 90 degrees in the feeding direction, wherein a driven-side gear 202 is fixedly secured to the rotary hook 20 and a drive-side gear 201 (FIG. 6) is fixedly secured to the lower shaft S2 by a fitting engagement. The lower shaft S2 is rotatably driven in synchronism with the upper shaft S1 by means of a timing belt TB2 at a rotational speed increased twice compared with the rotational speed of the upper shaft (1:2). The timing of this rotary hook 20 is adjusted such that the rotary hook 20 is rotated twice per one upward and downward movement of the needle 10 and the loop-taker point 21 of the rotary hook 20 intercepts the loop of upper thread 1 when the needle 10 is elevated from the lowermost position.

A feed quantity of a feed dog FB for feeding the fabric is also subjected to the drive control of the pattern stitch generating device. The fabric feed movement of the feed dog FB constitutes one step of the fabric feeding wherein a feed drive portion 120 having a triangular cam is driven by the lower shaft S2, elevates the feed dog FB so as to push the work upwardly, makes the feed dog FB advance while maintaining the elevated state so as to move the work in the frontward direction, lowers the feed dog FB so as to leave the work on the throat plate 8, and retracts the feed dog FB to the original position.

Further, as shown in FIG. 1 and FIG. 2, the lockstitch/over-edge sewing machine is provided with a looper drive mechanism 50 which forms an over-edge stitch portion 7 by an upper looper thread 3 and a lower looper thread 4 which are respectively made to pass through an upper looper 30 which performs a reciprocating movement drawing a substantially arcuate trace L30 extending above and below the throat plate 8 and intersects the trace L10 of the needle 10 above the throat plate 8 and a lower looper 40 which draws a substantially arcuate trace L40 below the throat plate 8 and intersects the trace L10 of the needle 10 and the trace L30 of the upper looper 30 respectively.

The looper drive mechanism 50 is provided with a looper drive portion 60 (FIG. 6 and FIG. 7) which has a following constitution. That is, the upper looper 30 and the lower looper 40 are respectively disposed below the throat plate 8. Respective loop-taker points 31, 41 of the upper looper 30 and the lower looper 40 are arranged in the direction such that the loop-taker points 31, 41 pass a front side of the needle 10 as seen in the stitching direction. The upper looper 30 and the lower looper 40 are driven such that the upper looper 30 and the lower looper 40 perform movements having the traces L30, L40 on planes substantially parallel to each other. The upper looper thread 3 which is made to pass through the upper looper 30 which performs the reciprocating movement drawing the arcuate trace L30 which intersects the trace L10 of the needle 10 above the throat plate 8 and passes through the throat plate 8 is intercepted by the needle 10 descending from the uppermost position when the upper looper 30 is descended from an uppermost position.

The lower looper thread 4 which is made to pass through the lower looper 40 which performs the reciprocating movement drawing the trace L40 which intersects the trace L10 of the needle 10 and the trace L30 of the upper looper 30 below the throat plate 8 is intercepted by the descending needle 10 below the throat plate 8 when the lower looper 40 is moved from one end to the other end of the trace L40. The lower looper thread 4 is intercepted by the upper looper 30 elevating from the lowermost position when the lower looper 40 is moved to the other end. Due to such a constitution, the upper looper thread 3 and the lower looper thread 4 are interlooped each other at the edge portion 5*c* of the work 5 and, at the same time, the upper looper thread 3 is interlooped with the lockstitch portion 6 through an upper surface 5*a* of the work 5, and the lower looper thread 4 is interlooped with the lockstitch portion 6 through a lower surface 5*b* of the work 5 thus forming the over-edge stitch portion 7.

Figure 6:
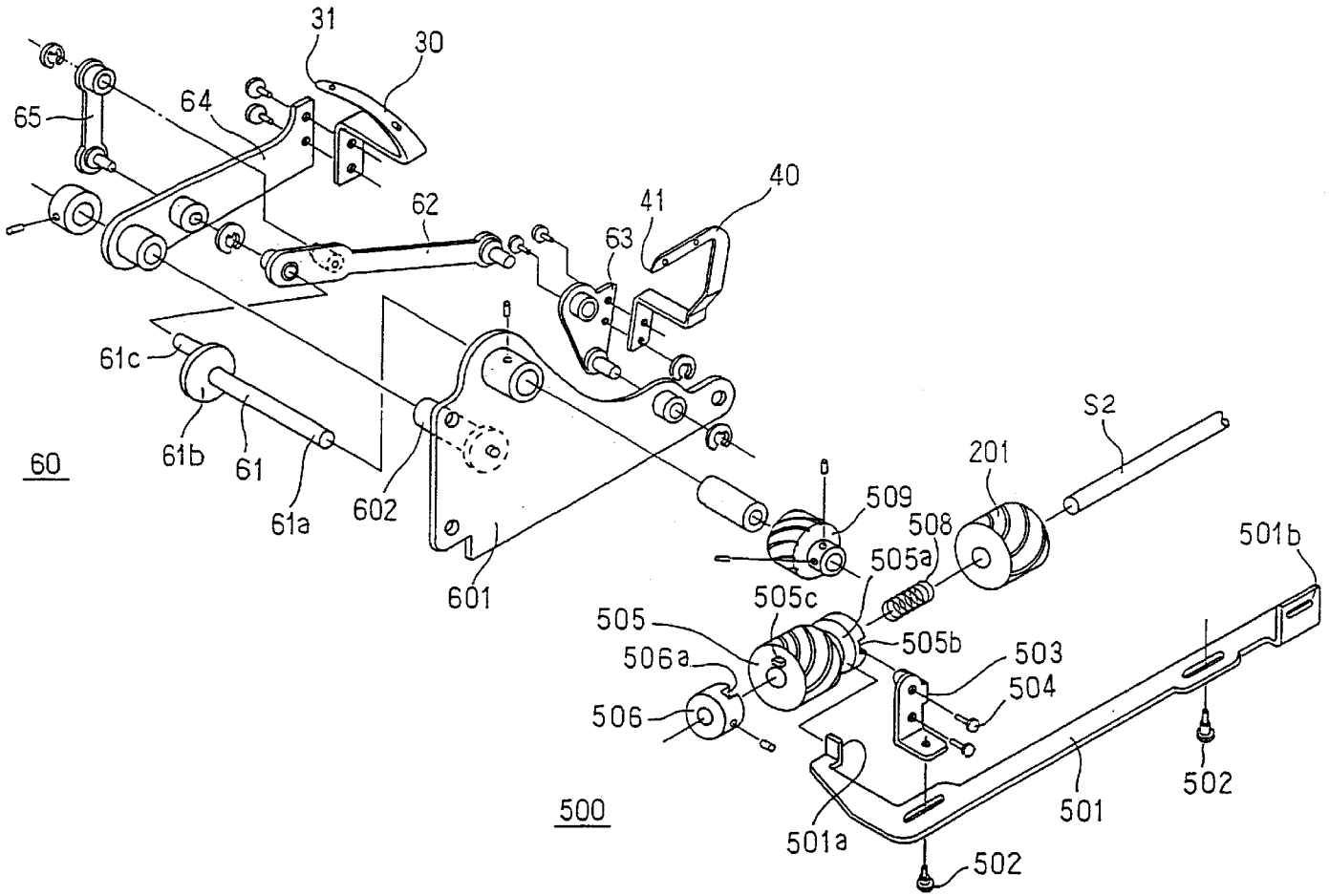
FIG. 6 is an exploded perspective view showing the crutch control portion and a looper drive portion in the looper drive mechanism of the sewing machine of the present invention.
Figure 7:
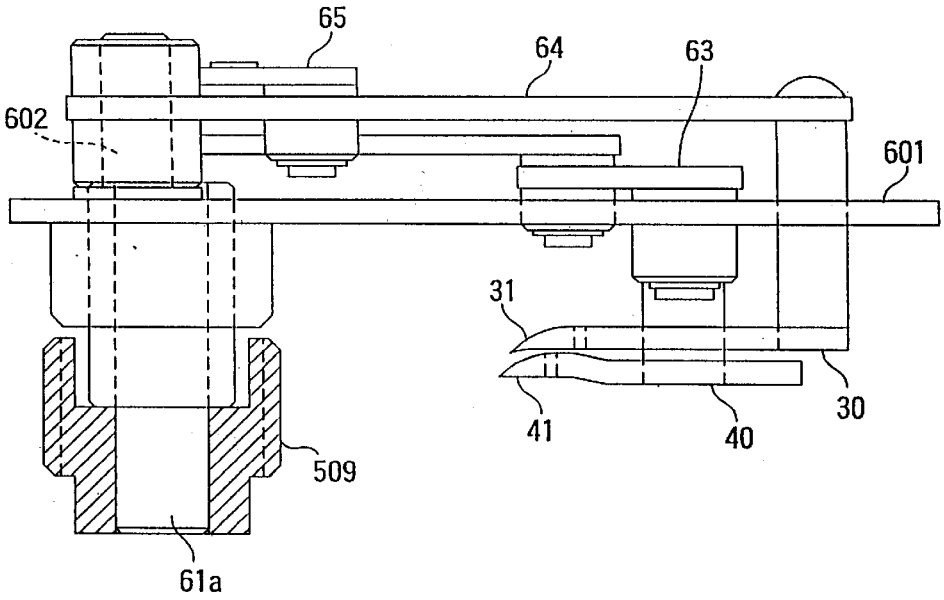
FIG. 7 is an upper plan view showing the looper drive portion in the looper drive mechanism of the sewing machine of the present invention.

The looper drive portion 60 is disposed below the throat plate 8 and, as shown in FIG. 6 and FIG. 7, includes a crank 61*b* which is mounted on one end of a looper drive shaft 61 to which the rotational movement is transmitted from the lower shaft S2 by way of a clutch 500 and is driven by the lower shaft S2, a lower looper drive link 62 which is connected to the crank 61*b*, a lower looper mounting arm 63 which is connected to the lower looper drive link 62 and carries the lower looper 40, an upper looper mounting arm 64 which is journalled in the frame FR and carries the upper looper 30 at one end thereof, and an upper looper drive link 65 which connects the lower looper drive link 62 and the upper looper mounting arm 64. These crank 61*c* and the like are incorporated into a looper base 601 mounted on the frame FR. To be more specific, the looper drive shaft 61 is rotatably secured to the looper base 601 and a crank pin 61*c* of the crank 61*b* is rotatably connected to one end of the lower looper drive link 62. This lower looper drive link 62 has the other end thereof rotatably connected to the one end of the lower looper mounting arm 63 and the other end of the lower looper mounting arm 63 is pivotally supported on the looper base 601. Further, the other end of the upper looper mounting arm 64 is pivotally mounted on the upper looper mounting arm shaft 602 fixedly secured to the looper base 601.

The over-edge stitching operation by the looper drive portion 60 having such a constitution is explained in conjunction with FIG. 5, FIG. 6, FIG. 7 and FIG. 8.

When the lower shaft S2 is rotated, the looper drive shaft 61 performs the rotational movement by way of the clutch 500 and the lower looper drive link 62 connected to the crank 61*b* of the looper drive shaft 61 transfers or converts this rotational movement into the reciprocating movement in the leftward and rightward direction. When the lower looper drive link 62 performs the reciprocating movement in the leftward and rightward direction, the lower looper mounting arm 63 is rocked about a pivoting point of the lower looper mounting arm 63 to the looper base 601 and hence, the lower looper 40 which is carried by the lower looper 63 rocks in an arcuate shape below the throat plate 8 between the right side and the left side of the needle 10 as seen from the front side of the sewing machine (FIG. 2(*a*)). Further, when the lower looper drive link 62 performs the reciprocating movement in the leftward and rightward direction, due to an upper looper drive link 65 which connects the lower looper drive link 62 and the upper looper mounting arm 64, the upper looper mounting arm 64 transfers the leftward and rightward reciprocating movement to the upward and the downward reciprocating movement about the upper looper mounting arm shaft 602 of the looper base 601 as the center. When the upper looper mounting arm 64 performs the upward and the downward reciprocating movement about the upper looper mounting arm shaft 602 as the center, the upper looper 30 rocks in an arcuate shape between a position located at the right side of the needle 10 and below the loop-taker point 41 of the lower looper 40 and a position located at the left side of the needle 10 and above the throat plate 8 as seen from the front side of the sewing machine (FIG. 2(*a*)).

In the clutch 500 which transmits the power from the lower shaft S2 to such a looper drive portion 60 or interrupts such a power transmission, at the time of forming the over-edge stitch portion 7, the power is transmitted from the lower shaft S2 to the looper drive shaft 51 so as to form the lockstitch portion 6 and the over-edge stitch portion 7 and, at the time of forming the lockstitch portion 6, the upper looper 30 is shunted at the lowermost position and the power transmission from the lower shaft S2 to the looper drive shaft 51 is interrupted so as to form the lockstitch portion 6 (FIG. 2(*b*)). Here, the looper drive portion 60 includes a looper drive screw gear MT3 which constitutes the motion transfer mechanism (FIG. 1). As shown in FIG. 6, this looper drive screw gear MT3 is provided for transmitting the rotational movement from the lower shaft S2 to the looper drive portion 60 after converting the direction of the rotational movement by 90 degrees in the feed direction, wherein a driven-side gear 509 is fixedly secured to the other end of the looper drive shaft 61 which is rotatably secured to the looper base 601, while the drive-side gear 505 is slidably fitted on the lower shaft S2.

Further, the clutch 500 includes a looper drive screw gear stopper 503 which is fixedly secured to the frame FR by a screw 504 and is fitted into a recessed portion 505*b* formed in one end of the drive-side gear 505, a clutch catcher 506 which is fixedly secured to one end of the lower shaft S2 and is provided with a clutch engaging recessed portion 506*a* in which a clutch pawl 505*c* formed on the other end of the drive-side gear 505 is fitted into an end surface thereof, a clutch spring 508 which is loosely fitted on the lower shaft S2 between the drive-side gear 201 of the rotary hook drive screw gear MT2 and the drive-side gear 505 of the looper drive screw gear MT3 and biases the drive-side gear 505 such that the clutch pawl 505*c* of the drive-side gear 505 is engaged with the clutch engaging recessed portion 506*a* of the clutch catcher 506, and a clutch changeover link 501 which is slidably mounted on the frame FR and a looper drive screw gear stopper 503 fixedly secured to the frame FR by means of stepped screws 502 and is provided with an L-shaped distal end portion 501*a* which is fitted into a movable groove 505*a* formed in the drive-side gear 505 of the looper drive screw gear MT3 at one end thereof.

As shown in FIG. 3 and FIG. 4, the clutch changeover link 501 is connected to the clutch control portion 510 of the clutch 500 which is operated in an interlocking manner with the needle stitching control portion 520. The clutch control portion 510 includes a clutch control link 511 which connects the other end of the clutch changeover link 501 and an end portion of the lower-side arm 536*d* of the needle stitching transfer arm 536 provided to the needle stitching control portion 520. The clutch control link 511 is provided with an elongated hole 511*a* at an end portion thereof which is connected with an end portion of lower arm 536*d* of the needle stitching transfer arm 536 and is slidable by connecting the clutch control link 511 with the needle stitching transfer arm 536 by a stepped screw 514. Further, a connection hole 511*b* is formed in the other end of the clutch control link 511 which is connected to the other end of the clutch changeover link 501, an adjusting elongated hole 501*b* is formed in the other end of the clutch changeover link 501, a connecting block 512 is loosely fitted into a connecting hole 511*b* of the clutch control link 511, and the clutch changeover link 501 is fixedly secured to the connecting block 512 such that the position of the clutch changeover link 501 can be adjusted by way of a screw 513 and a washer 515 along with an elongated hole 501*b* for adjustment. Further, a tension spring 517 is extended between a spring engaging hole 511*c* formed in the clutch control link 511 and a spring engaging hole formed in a lower arm 536*d* of the needle stitching transfer arm 536. Due to such a constitution, the clutch control link 511 is always resiliently biased in the direction that the clutch control link 511 is pulled toward the needle stitching transfer arm 536.

In the clutch 500 and the clutch control portion 510 having the above-mentioned constitutions, in performing the over-edge stitching, since the needle stitching transfer arm 536 is rotated in the clockwise direction by the biasing force of the tension spring 538 as seen from the front side of the sewing machine, the clutch control link 511 connected to the end portion of the lower arm 536*d* of the needle stitching transfer arm 536 is moved in the leftward direction and hence, the clutch changeover link 501 connected to the clutch control link 511 is also moved in the leftward direction. When the clutch changeover link 501 is moved in the leftward direction, the L-shaped distal end portion 501*a* of the clutch changeover link 501 which is fitted into the moving groove 505*a* of the drive-side gear 505 of the looper drive screw gear MT3 moves the drive-side gear 505 in the leftward direction so that the recessed portion 505*b* of the drive-side gear 505 is disengaged from the looper drive screw gear stopper 503 and simultaneously the clutch pawl 505*c* of the drive-side gear 505 is engaged with the clutch engaging recessed portion 506*a* of the clutch catcher 506 fixedly secured to the lower shaft S2 (FIG. 9(*a*)). In this manner, since the rotational movement of the lower shaft S2 is transmitted to the driven-side gear 509 by way of the drive-side gear 505, the upper looper 30 and the lower looper 40 of the looper drive portion 60 are driven.

Further, in finishing the over-edge stitching, by rotating the needle stitching transfer arm 536 in the counter-clockwise direction as seen from the front side of the sewing machine against the biasing force of the tension spring 538, the clutch control link 511 connected to the end portion of the lower arm 536*d* of the needle stitching transfer arm 536 is moved in the rightward direction and hence, the clutch changeover link 501 connected to the clutch control link 511 is also moved in the rightward direction. When the clutch changeover link 501 is moved in the rightward direction, the L-shaped distal end portion 501*a* of the clutch changeover link 501 which is fitted into the moving groove 505*a* of the drive-side gear 505 of the looper drive screw gear MT3 moves the drive-side gear 505 in the rightward direction so that the recessed portion 505*b* of the drive-side gear 505 can be engaged with the looper drive screw gear stopper 503 against the biasing force of the compression spring 508 and simultaneously the clutch engaging recessed portion 506*a* of the clutch catcher 506 fixedly secured to the lower shaft S2 is disengaged from the clutch pawl 505*c* of the drive-side gear 505 (FIG. 9(*b*)). In this manner, since the rotational movement of the lower shaft S2 is not transmitted to the driven-side gear 509, the driven gear 502 is not rotated and hence, the operations of the upper looper 30 and the lower looper 40 of the looper drive portion 60 are stopped.

The lockstictch/over-edge stitch sewing machine provided with such a looper drive mechanism 50 may by further provided with a cutter drive mechanism 70 which cuts the fabric edge 5*c* of the fabric 5 (FIG. 2) by an upper cutter 72 which is moved upwardly and downwardly by way of a motion transfer mechanism 71 (FIG. 10, FIG. 11) which is operated in an interlocking manner with the rotary shaft of the lockstictch/over-edge stitch sewing machine, that is, the upper shaft S1 and a lower cutter 73 which cooperates with the upper cutter 72.

This cutter drive mechanism 70 is provided with a cutter drive portion 74 (FIG. 1, FIG. 10) which slidably guides the upper cutter 72 pivotally mounted on the frame FR.

The motion transfer mechanism 71 is connected with the upper cutter 72 by way of a clutch 75 (FIG. 10) which transmits power to the upper cutter 72 at the time of operating the cutter of the cutter drive portion 74 and pivotally moves the cutter drive portion 74 to a shunting position and interrupts the transmission of power to the upper cutter 72 at the time that the cutters of the cutter drive portion 74 are not operated.

As shown in FIG. 1, FIG. 10, FIG. 11 and FIG. 12, the motion transfer mechanism 71 is constituted by a first quadric crank chain LK1 which consists of four links 76, 77(78), 79, 80 connecting the upper shaft S1 as the rotary shaft and the frame FR and a second quadric crank chain LK2 which consists of four links 79, 81, 82, 83 while using one link 79 of the first quadric crank chain LK1 and a joint N4 of the frame FR and using the drive portion 751 of the clutch 75 as another link 82. In the first quadric crank chain LK1, the link 78 is fixedly secured to the link 77 while the link 78 is connected to the link 80. Here, the link 76 is a fixed link.

Figure 11:
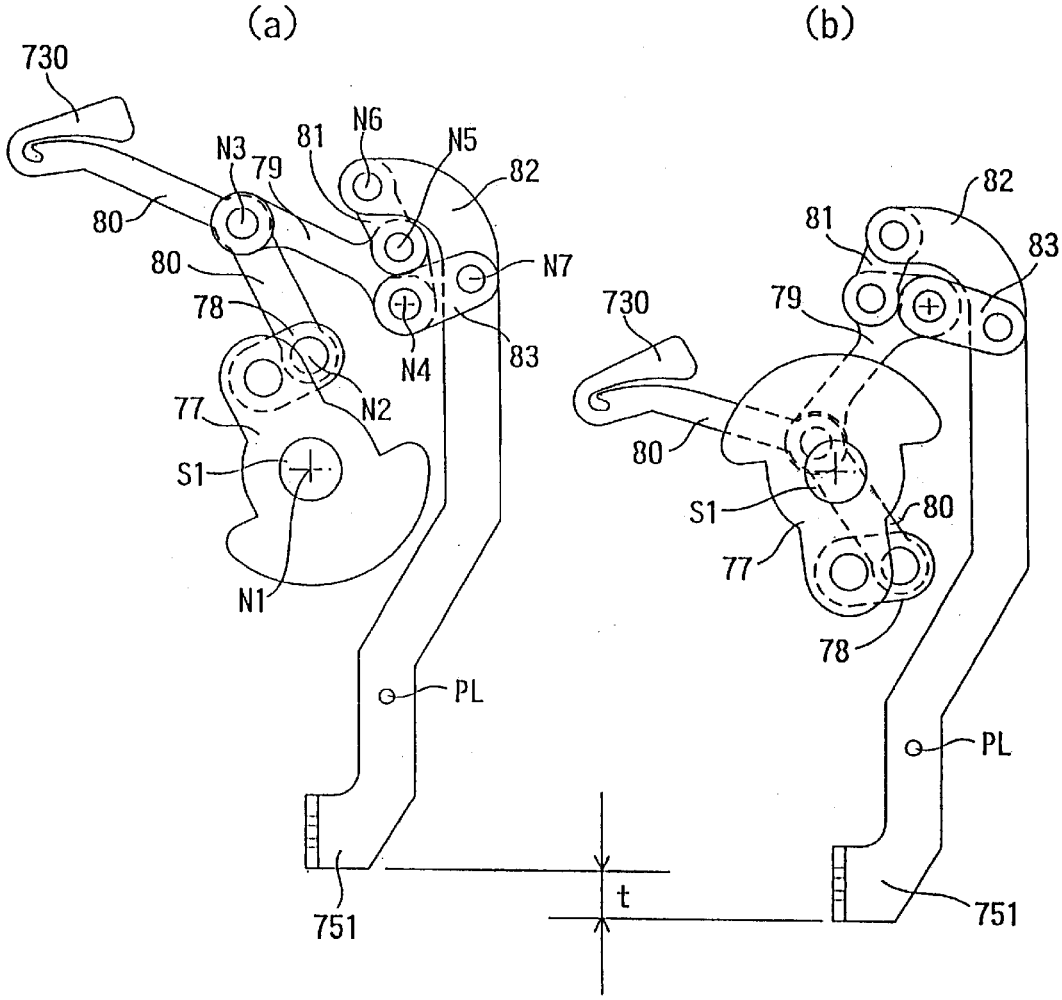
FIG. 11(*a*) and FIG. 11(*b*) are explanatory views showing the operable state of the motion transfer mechanism in the cutter drive mechanism of the sewing machine of the present invention.
Figure 12:
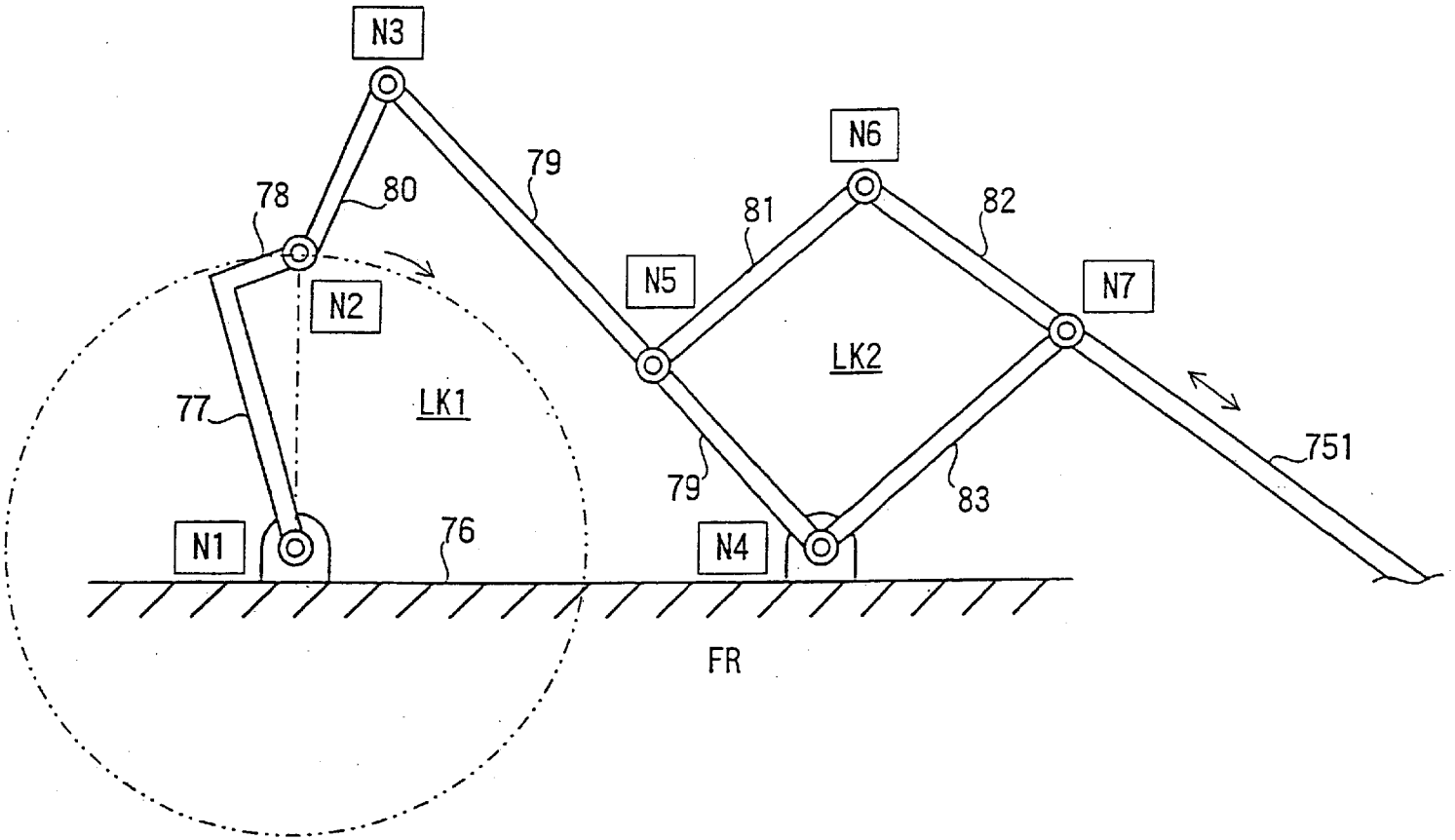
FIG. 12 is an explanatory view showing the operation of the motion transfer mechanism in the cutter drive mechanism of the sewing machine of the present invention.

In the embodiment shown in FIG. 11, the motion transfer mechanism 71 is provided for taking the motion from a mechanism which drives a needle thread take-up 730 upwardly and downwardly using power transmitted from the upper shaft S1 as the rotary shaft and transferring the motion to a motion to move the upper cutter 72 upwardly and downwardly. However, the motion transfer mechanism 71 may be provided for taking a motion from a mechanism which drives the needle 10 upwardly and downwardly using power transmitted from the upper shaft S1 as the rotary shaft and transferring the motion to a motion to move the upper cutter 72 upwardly and downwardly. The needle thread take-up 730 is driven upwardly and downwardly by the power transmitted from the upper shaft S1 by way of four links 76, 77(78), 79, 80.

Figure 13:
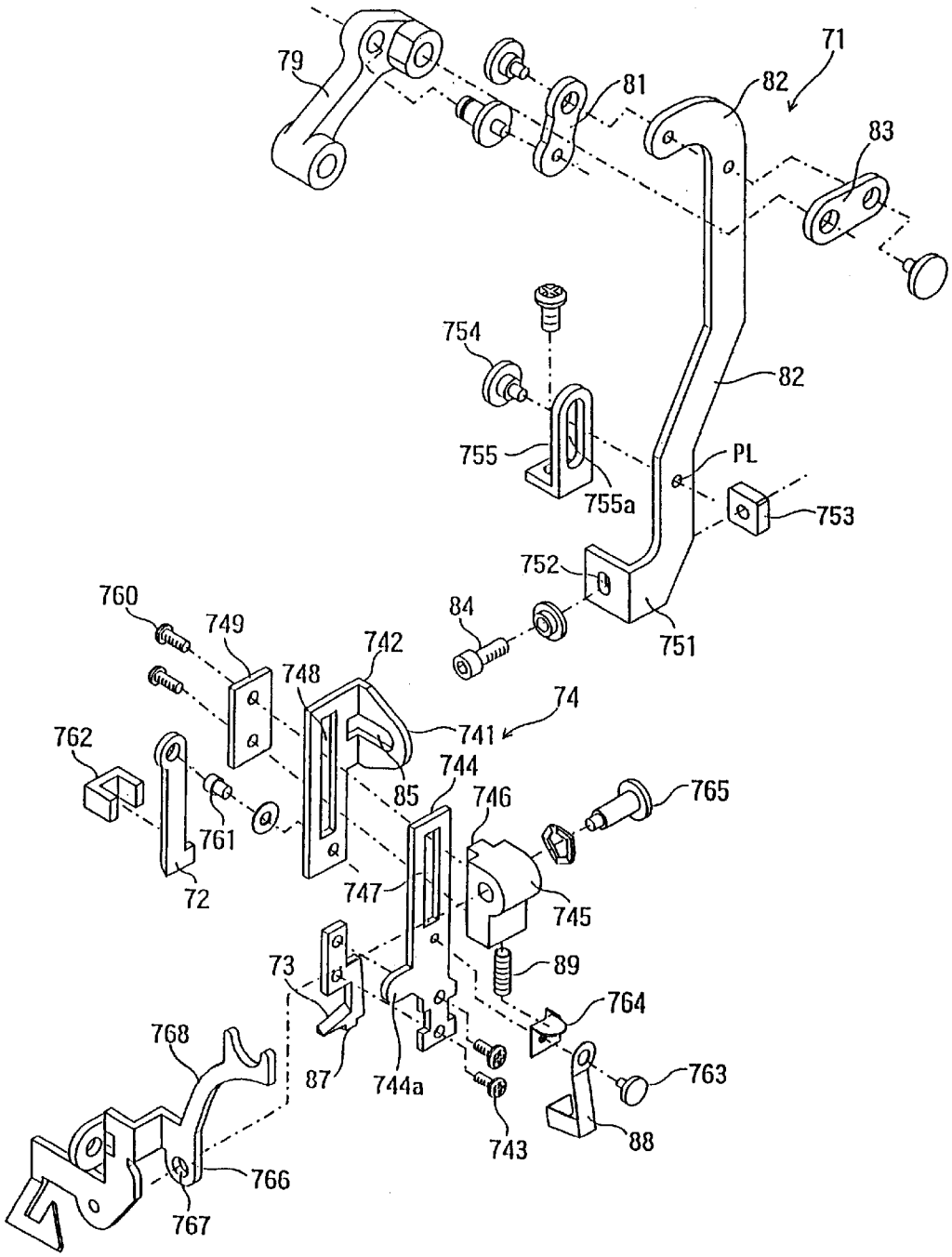
FIG. 13 is an exploded perspective view showing the motion transfer mechanism and the cutter drive portion in the cutter drive mechanism of the sewing machine of the present invention.

The clutch 75 includes, as shown in FIG. 10 and FIG. 13, a pin 84 which is formed on the other link 82 as a drive portion 751 and an elongated groove 85 which is formed in the upper cutter 72 as a driven portion 741 and in which the pin 84 is fitted. The pin 84 which constitutes the drive portion 751 is threadedly mounted in a mounting hole 752 formed in a lower bent end portion of the other link 82 using a nut 753.

In the cutter drive portion 74, the lower cutter 73 is slidably mounted on a cutter drive plate 742 which constitutes the driven portion 741. To achieve such a slide structure, the lower cutter 73 is fixedly secured to the slide plate 744 by small bolts 743. A protrusion 746 of a pivotally movable member 745 is fitted in an opening 747 of the slide plate 744 and an opening 748 of the cutter drive plate 742 and the pivotally movable member 745 is fixedly secured to a stopper 749 by small bolts 760. Due to such a constitution, the cutter drive portion 74 can slidably mount the slide plate 744, that is, the lower cutter 73 within a relative dimensional relationship between the openings 747, 748 and the protrusion 746.

The upper cutter 72 is replaceably mounted on the cutter drive plate 742 of the cutter drive portion 74 by a pin 761. The cutter drive portion 74 is provided with a cutter-side pressure resilient member 88 which presses the upper cutter 72 to the lower cutter 73. The cutter-side pressure resilient member 88 is constituted by a resilient U-shaped member and is pivotally mounted on the slide plate 744 by a pin 763. In the state that the upper cutter 72 is mounted on the cutter drive plate 742 by the pin 761, a resilient U-shaped member 762 is fitted on the cutter-side pressure resilient member 88 so that the resilient U-shaped member 762 is held and the upper cutter 72 is pressed to the lower cutter 73.

Figure 14:
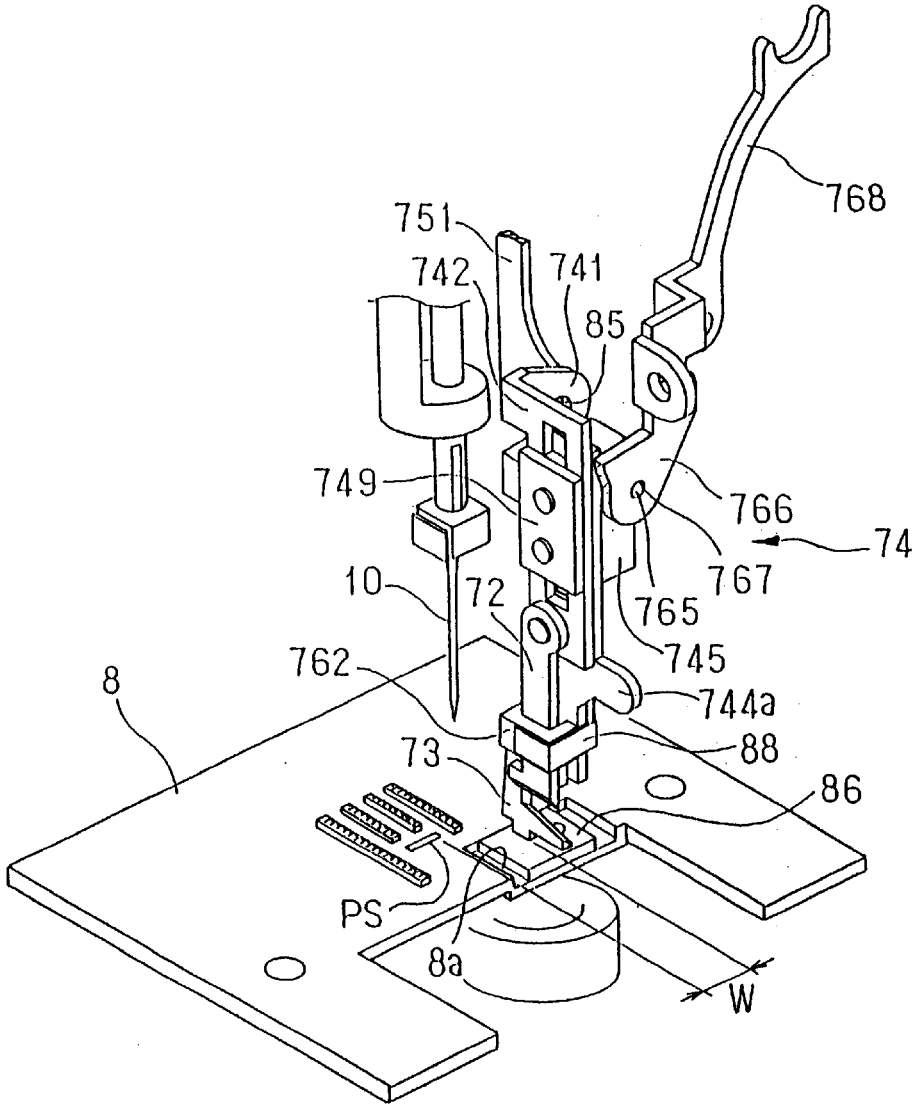
FIG. 14 is a perspective view showing the cutter operable state in the cutter drive mechanism of the sewing machine of the present invention.
Figure 15:
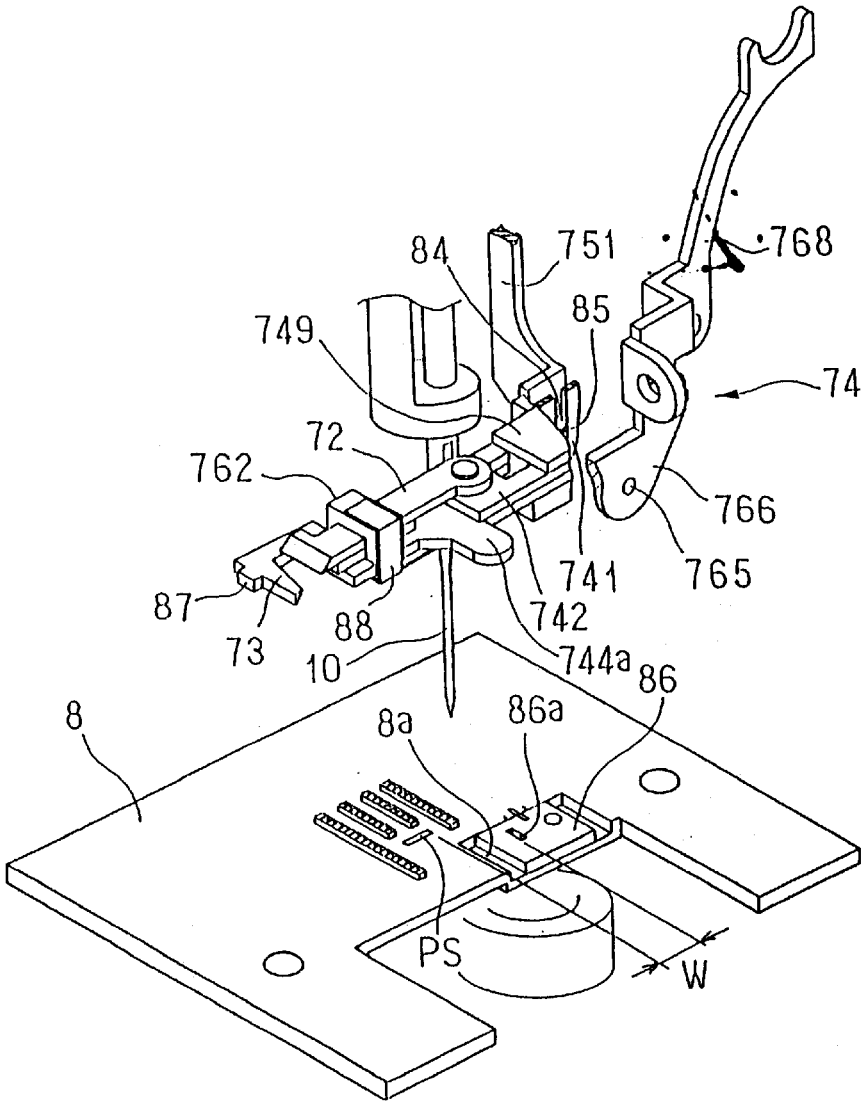
FIG. 15 is a perspective view showing the cutter non-operable state in the cutter drive mechanism of the sewing machine of the present invention.

As shown in FIG. 14 and FIG. 15, the lower cutter 73 includes a locating locking-portion 87 which locates the cutter drive portion 74 to a locating recessed portion 86*a* of a locating plate 86 provided to the throat plate 8 to a needle stitching position PS of the needle 10 at the time of operating the cutters. The locating plate 86 provided with the locating recessed portion 86*a* is constituted such that the position of the locating plate 86 can be adjusted in the leftward and rightward direction so as to change the stitching width W to the needle stitching position PS. That is, the locating plate 86 is incorporated in the throat plate 8 in such a manner that the locating plate 86 can adjust the position thereof in the leftward and rightward direction wherein the position of the locating plate 86 can be adjusted in the stitch width W direction to the recessed portion 8*a* formed in the throat plate 8. After being located, the locating plate 86 is fixedly secured to the throat plate 8 by bolts or the like.

The lower cutter 73 is slidably mounted in the cutter drive portion 74 and the cutter drive portion 74 is provided with a locating biasing member 89 which presses the locating locking portion 87 into the locating recessed portion 86*a* of the locating plate 86 provided to the throat plate 8 at the time of performing the cutting operation. The locating biasing member 89 is interposed between the pivotally movable member 745 and a receiving plate 764 which is fixedly secured by a pin 763 inserted into a mounting hole formed in the pivotally movable member 745 and presses the locating engaging member 87 into the locating recessed portion 86*a* of the locating plate 86 at the time of performing the cutting operation.

The pivotally movable member 745 of the cutter drive portion 74 is pivotally supported in a pivot hole 767 of the stopper 766 by a pin 765. The stopper 766 is fixedly secured to the frame FR by a stopper arm 768. In this manner, the cutter drive portion 74 is pivotally supported on the frame FR and slidably guides the upper cutter 72.

Figure 16:
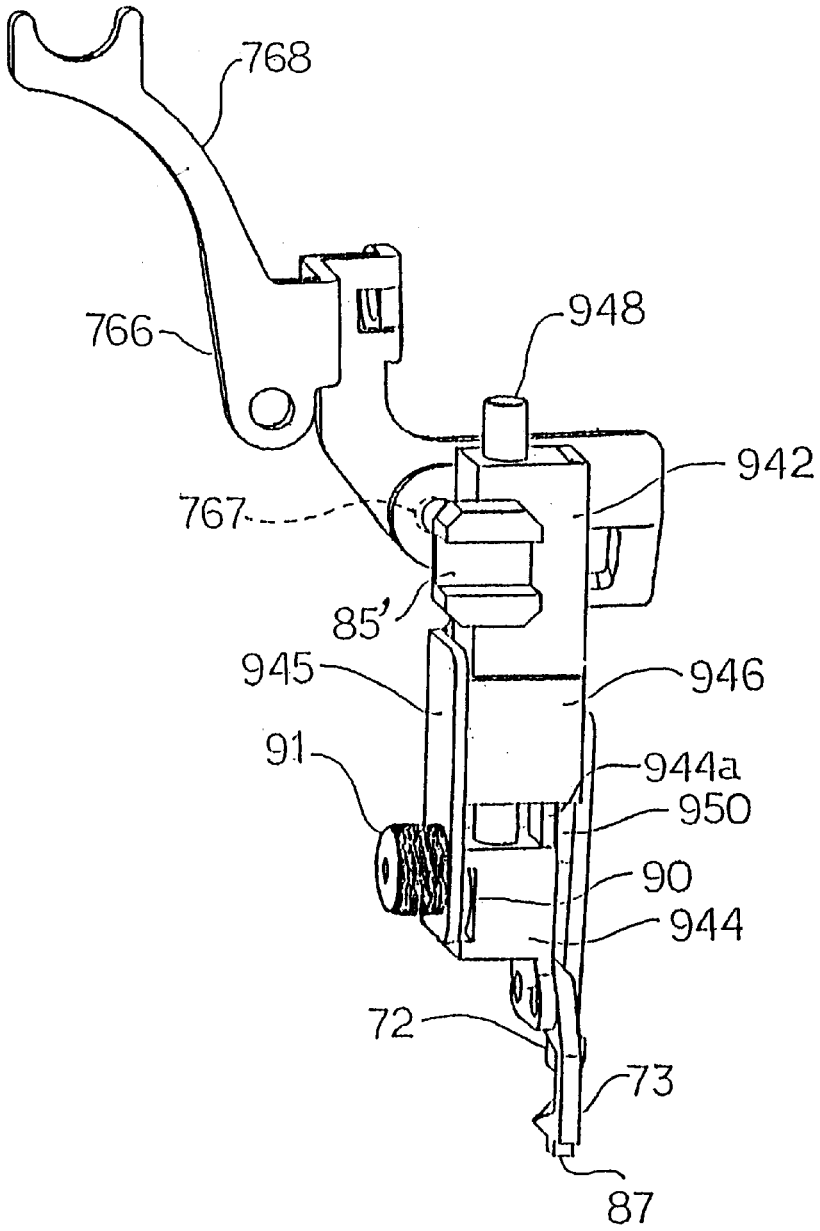
FIG. 16 is a perspective view in the state that the sewing machine is seen from the backside wherein a cutter drive portion of another embodiment in the cutter drive mechanism of the sewing machine of the present invention is shown.

Further, as shown in FIG. 16, without using the locating biasing member 89 and the receiving plate 764, the lower cutter 73 may be slidably mounted in the cutter drive portion 74 and the cutter drive portion 74 may be provided with a locating eccentric cam 90 which presses the locating locking portion 87 into the locating recessed portion 86*a* of the locating plate 86 provided to the throat plate 8 at the time of performing the cutting operation. The cutter drive portion 74 provided with the eccentric cam 90 includes a cutter drive body 942 which is provided with a groove 85' into which a pin 84 of the drive portion 751 constituting a part of the clutch 75 is fitted and to which the upper cutter 72 is fixedly secured, a slide guide body 946 which is disposed parallel to the cutter drive body 942, a slide body 944 which is disposed parallel to the slide guide body 946 and to which the lower cutter 73 is fixedly secured, and a slide shaft 948 on which three parts are slidably mounted in the order of the cutter drive body 942, the slide guide body 946 and the slide body 944.

The slide guide body 946 is provided with a guide groove in which a protrusion 944*a* formed on the slide body 944 is slidably fitted in the axial direction of the slide shaft 948 and a pivotally movable member 945 which is engaged with the slide body 944 is fixedly mounted on the slide guide body 946. The slide guide body 946 is fixedly secured to the slide shaft 948 by a small bolt. The slide body 944 is provided with a groove portion which works as a cam follower at one end portion thereof and is moved upwardly or downwardly by the rotational movement of the locating eccentric cam 90 which is rotatably mounted by the manipulation of a manipulating knob 91 about an axis hole formed in the pivotally movable member 945. Further, a cutter-side biasing member 950 is fixedly secured to the cutter drive body 942 which presses the upper cutter 72 to the lower cutter 73. Further, the pivotally movable member 945 of the cutter drive portion 74 is pivotally supported in a pivot hole 767 of a stopper 766 by a pin. The stopper 766 is fixedly secured to the frame FR by the stopper arm 768. In this manner, the cutter drive portion 74 is pivotally mounted on the frame FR and slidably guides the upper cutter 72.

According to the cutter drive portion 74 having such a constitution, by rotating the manipulation knob 91, the locating eccentric cam 90 is made offset so that the lower cutter 73 is moved upwardly and hence, the state that the locating locking portion 87 of the lower cutter 73 is fitted into the locating recessed portion 86*a* of the locating plate 86 provided to the throat plate 8 can be released. Further, with the rotational manipulation of the manipulating knob 91, the lower cutter 73 is moved downwardly and hence, the locating locking portion 87 of the lower cutter 73 can be fitted into the locating recessed portion 86*a* provided to the throat plate 8.

The manner of lockstitch/over-edge stitch operation performed by the lockstitch/over-edge stitch sewing machine having the above-mentioned constitution is explained hereinafter.

Here, the stitch of the lockstitch/over-edge stitch includes, as shown in FIG. 2, the lockstitch portion 6 consisting of the upper thread 1 and the lower thread 2 and the over-edge portion 7 consisting of two looper threads made of the upper looper thread 3 and the lower looper thread 4, wherein the stitch is formed by making the lockstitch portion 6 and the over-edge portion 7 intersect each other. That is, the upper thread 1 and the lower thread 2 respectively form stitches 1*a*, 2*a* on an upper surface 5*a* and a lower surface 5*b* of the work, for example, the fabric 5 having a two-plied structure which are parallel to the fabric surface, and the upper thread 1 and the lower thread 2 are made to interlace each other in the vertical direction of the fabric 5, for example, at the center in the thickness-wise direction thus forming the stitch which penetrates the fabric 5 whereby the lockstich portion 6 is formed.

On the other hand, the upper looper thread 3 and the lower looper thread 4 are provided for forming the over-edge portion 7 which can prevent the unraveling of the edge portion 5*c* of the fabric 5. The upper looper thread 3 and the lower looper thread 4 interlace each other at the edge portion 5*c* of the fabric 5, the upper looper thread 3 penetrates the upper surface 5*a* of the fabric 5 and intersects the upper end of the lockstitch portion 6 and the lower looper thread 4 penetrates the lower surface 5*b* of the fabric 5 and intersects the lower end of the lockstitch portion 6.

In this manner, the stitch of the lockstitch/over-edge stitching is constituted by the upper thread 1 which constitutes a single thread, the lower thread 2 which constitutes the rotary hook thread, and two looper threads 3, 4, wherein the over-edge portion 7 formed by the looper threads 3, 4 intersect the lockstitch portion 6 formed of upper thread 1 and the lower thread 2 on both sides of the fabric 7 so that the lockstitch and the over-edge stitch are connected to each other thus forming the stitch.

In the lockstitch/over-edge stitch sewing machine forming the stitch constituted by connecting both of the lockstitch and the over-edge stitch, to perform the over-edge stitching first of all, the stitch changeover knob NB is manipulated by the sewing person so as to, for example, select the linear stitching and to set a feed quantity to an optimal quantity for the over-edge stitching such that the stitch changeover shaft 111 of the stitch changeover device 110 is rotated to a position where the security pin 536*b* of the needle stitching transfer arm 536 is protruded into the recessed portion 527*a* of the needle stitching changeover cam 527 (FIG. 3 and FIG. 4).

In this state, when the sewing person pushes the over-edge stitch changeover button BT against the biasing force of the compression spring 534, the distal end of the over-edge stitch changeover button BT presses the receiving portion 532*a* of the needle stitching transfer arm holding plate 532 of the needle stitching control portion 520 so as to make the needle stitching transfer arm holding plate 532 rotate in the counter-clockwise direction. Due to this rotation, the stopper 532*b* of the needle stitching transfer arm holding plate 532 is retracted and hence, the needle stitching transfer arm 536 supported by this stopper 532*b* is rotated in the clockwise direction about the stepped screw 537 as the center by the biasing force of the tension spring 538. Accordingly, the security pin 515*b* of the needle stitching transfer arm 536 is protruded into the recessed portion 527*a* of the needle stitching transfer cam 527 until the security pin 515*b* comes into contact with a bottom surface of the recessed portion 527*a* (FIG. 3 and FIG. 4).

Further, when the needle stitching transfer arm 536 is rotated in the clockwise direction about the stepped screw 537 as the center, the intermediate arm 536*c* of the needle stitching transfer arm 536 pushes up the needle stitching transfer link 539 connected to the needle stitching transfer arm 536, and the needle stitching adjustment plate 521 and the needle stitching transfer pawl 522 which are integrally formed are rotated in the clockwise direction. Due to this rotation, the needle stitching transfer pawl 522 moves the needle-bar pulling bar 526 which is biased in the leftward direction by the tension spring 529 in the rightward direction by way of the needle stitching transfer pin 526*d* fixedly secured to the needle-bar pulling bar 526 (FIG. 1 and FIG. 3). Accordingly, the irrespective of the needle stitching position control by the stitch changeover device 110, the needle stitching position can be shifted to the rightmost position which is optimal for the over-edge stitching. To prevent the worsening of the needle position accuracy of the rightmost position optimal for the over-edge stitching which may be brought about the error of portions per se or the error generated in assembling, the needle stitching transfer pawl 522 is fixedly secured to the needle stitching adjustment plate 521 by the screw 525 and when the needle position adjustment is necessary, the screw 525 is loosened and the position adjustment of the needle stitching transfer pawl 522 can be performed.

Further, when the needle stitching transfer arm 536 is rotated in the clockwise direction about the stepped screw 537 as the center, the clutch changeover link 501 is moved in the leftward direction by way of the clutch control link 511 connected to the end portion of the lower arm 536*d* of the needle stitching transfer arm 536 (FIG. 1, FIG. 3, FIG. 4 and FIG. 6). Accordingly, the L-shaped distal end portion 501*a* of the clutch changeover link 501 fitted into the moving groove 505*a* of the drive-side gear 505 of the looper drive screw gear MT3 moves the drive-side gear 505 in the leftward direction so as to disengage the recessed portion 505*b* of the drive-side gear 505 from the looper drive screw gear stopper 503 and to engage the clutch pawl 505*c* of the drive-side gear 505 with the clutch engaging recessed portion 506*a* of the clutch catcher 506 fixedly secured to the lower shaft S2 (FIG. 9(*b*)). Accordingly, the rotational movement of the lower shaft S2 is transmitted to the driven-side gear 509 by way of the drive-side gear 505 so that the upper looper 30 and the lower looper 40 of the looper drive portion 60 can be driven.

In such a state that the upper looper 30 and the lower looper 40 of the looper drive portion 40 can be driven, the lockstitch portion 6 is formed such that the upper thread 1 which is made to pass through the needle 10 penetrates the fabric 5 following the upward and downward movement of the needle 10 generated by the needle bar drive portion MT1 and thereafter the loop-taker point 21 of the rotary hook 20 intercepts the upper thread 1 at a point R when the needle 10 starts to elevate from the lowermost position so as to make the upper thread 1 and the lower thread 2 interlace with each other, and further, the lower thread 2 is pulled up when the upper thread 1 is pulled up by the needle 10 and the looper thread take-up 730. By repeating the above-mentioned operation every one stitch feed, the continuous lockstitch portion 6 is formed (FIG. 2).

Figure 8:
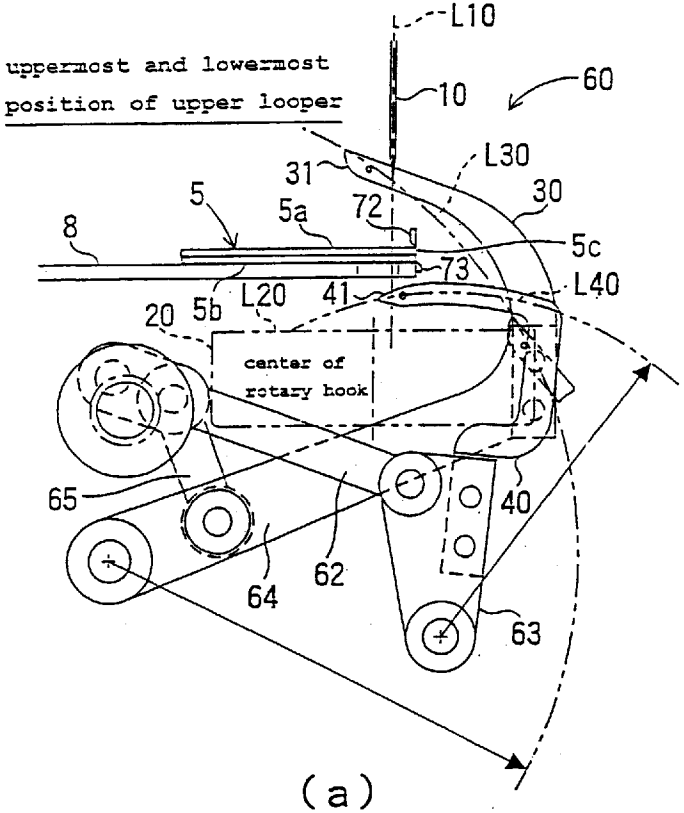
FIG. 8 is an explanatory view showing the operable state of the looper drive portion in the looper drive mechanism of the sewing machine of the present invention, wherein FIG. 8(*a*) is a view showing a point where a needle intercepts an upper looper thread and FIG. 8(*b*) is a view showing a point where the needle intercepts a lower looper thread.
Figure 8:
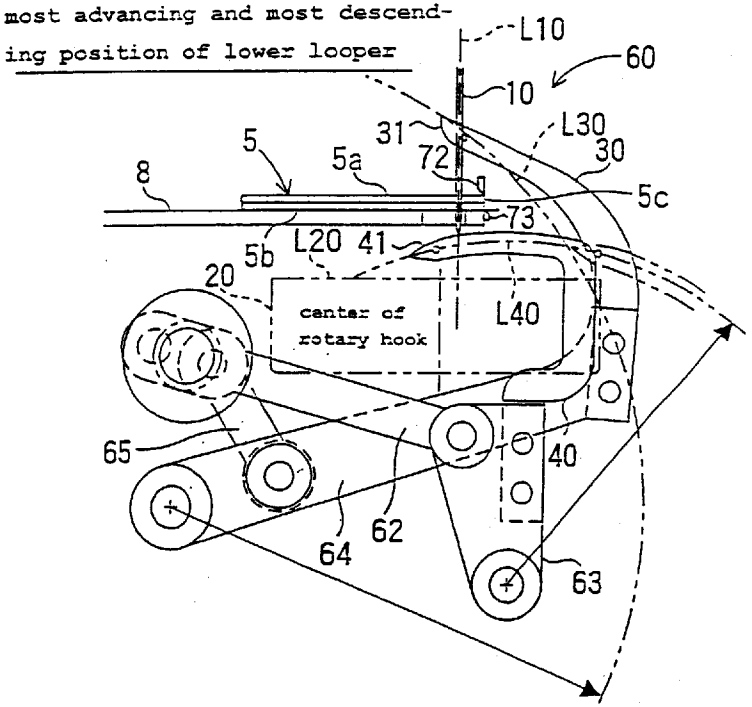

Further, in forming the over-edge stitch portion 7, when the upper looper 30 disposed in the uppermost position performs the upward and downward movement of the upper looper mounting arm 64, the upper looper thread 3 is intercepted by the needle 10 in the midst P point of the descending of the upper looper mounting arm 64 and hence, the upper end of the lockstitch portion 6 and the upper looper thread 3 interlace each other on the upper surface of the fabric (FIG. 8(*a*)).

Subsequently, at the time of performing the leftward and rightward reciprocating movement of the lower looper mounting arm 63, the lower looper thread 4 of the lower looper 40 moving in the rightward direction from the leftmost position is intercepted by the needle 10 descending from the uppermost position at a Q point and hence, the lower end of the lockstitch portion 6 and the lower looper thread 4 intersect each other on the lower surface of the fabric (FIG. 8(*b*)). Further, at the time of performing the leftward and rightward reciprocating movement of the lower looper mounting arm 63, the lower looper thread 4 of the lower looper 40 retracting in the rightward direction is intercepted by the upper looper 30 elevating from the lowermost position due to the upper looper mounting arm 64 at an S point and hence, the upper looper thread 3 and the lower looper thread 4 interloop each other at the edge portion 5*c* of the fabric 5 whereby the over-edge portion 7 is formed (FIG. 2)). By repeating the above-mentioned operation with one stitch feed as a cycle, the stitch which makes the over-edge portion 7 intersect respective lockstitch every one stitch can be obtained.

Further, the rotational movement of the rotary shaft of the sewing machine, for example, the upper shaft S1 in the drawing is transferred to the upward and downward movement by way of the motion transfer mechanism 71 (FIG. 1, FIG. 10, FIG. 11 and FIG. 12) which is operated in an interlocking manner with the above-mentioned rotational movement. That is, when the upper shaft S1 is rotated, the first quadric crank chain LK1 is rocked wherein the links 77, 78 are used as cranks and the link 80 is used as a connecting rod and the link 79 is used as a rocker arm. By the rocking of the link 79, the link 81 of the second quadric crank chain LK2 is rocked and the link 82 and accordingly the drive portion 751 of the clutch 75 performs the upward and downward movement. Here, the motion trace of the link 82 draws an elliptical trace due to the quadric crank chain mechanisms LK1, LK2 and draws an approximate straight line in the vertical direction at a PL point in the vicinity of the drive portion 751 so that the reaction from the cutter drive portion 74 is supported by a guide pin 754 held at the PL point of the link 82 which passes through an elongated guide hole 755*a* formed in the guide plate 755 fixedly secured to the frame FR (FIG. 10, FIG. 11 and FIG. 13). Due to such a constitution, the motion of the drive portion 751 in the lateral direction is restricted and only the upward and downward motion can obtain a stroke t (FIG. 11) per one rotation of the upper shaft S1.

The upward and downward motion obtained by the motion transfer performed by the motion transfer mechanism 71 is transmitted to the upper cutter 72 by way of the pin 84 of the drive portion 751 of the clutch 75 and the elongated groove 85 in which the pin 84 of the cutter drive plate 742 of the cutter drive portion 74 which constitutes the driven portion 741 is filled. In the cutter operable state (FIG. 14) in which the locating locking portion 87 of the lower cutter 73 is fitted into the locating recessed portion 86*a* of the locating plate 86 provided to the throat plate 8 so that the cutter drive portion 74 is located to the needle stitching position PS of the needle 10, the upper cutter 72 is slidably guided on the slide plate 744 by the cutter drive plate 742 of the cutter drive portion 74 pivotally mounted on the frame FR. In this cutter operable state, the cutter drive portion 74 is held in the vertical state around the pin 765 and the longitudinal direction of the elongated groove 85 is directed in the horizontal direction, the pin 84 of the drive portion 751 of the clutch 75 and the elongated groove 85 of the driven portion 741 allows the power transmission and hence, the power is transmitted to the upper cutter 72 at the time of performing the cutter operation of the cutter drive portion 74. Accordingly, the fabric edge 5*c* of the fabric 5 is cut by the upper cutter 72 which performs the upward and the downward movement and the lower cutter 73 which is cooperatively operated with the upper cutter 72.

In this manner, by performing the lockstiching and the like while cutting the fabric edge 5*c* of the fabric 5, it becomes also possible to perform the over-edge stitching simultaneously with the lockstitching.

Further, in transferring link the over-edge stitching to the lockstitching, by selecting the stitching other than the linear stitching with the manipulation of the stitch changeover knob NB after stopping the sewing machine, the stitch changeover shaft 111 of the stitch changeover device 110 is rotated and the security pin 536*b* of the needle stitching transfer arm 536 is disengaged from the recessed portion 527*a* of the needle stitching transfer cam 527 fixedly secured in a given position of the stitch changeover shaft 111 and hence, the needle stitching transfer arm 536 is rotated in the counter-clockwise direction about the stepped screw 37 as the center against the biasing force of the tension spring 538 (FIG. 1, FIG. 3 and FIG. 4). Accordingly, the intermediate arm 536*c* of the needle stitching transfer arm 536 pulls the needle stitching transfer link 539 connected to the needle stitching transfer arm 536 downwardly and hence, the needle stitching adjustment plate 521 and the needle stitching transfer pawl 522 which are integrally formed are rotated in the counter-clockwise direction. When the needle stitching transfer pawl 522 is rotated in the counter-clockwise direction, the needle-bar pulling bar 526 is moved in the leftward direction by the biasing force of the tension spring 529 and hence, the position optimal for the lockstitching can be obtained.

Further, when the needle stitching transfer arm 536 is rotated in the counter-clockwise direction about the stepped screw 537 as the center, the lower arm 536*d* of the needle stitching transfer arm 536 forces the clutch control link 511 to move in the rightward direction. However, when the recessed portion 505*b* of the drive-side gear 505 of the looper drive screw gear MT3 and the looper drive screw gear stopper 503 fixedly secured to the frame FR are not located at the same position, they cannot get the fitting engagement. In view of the above, the needle stitching transfer arm 536 forces the stepped screw 514 fixedly secured to the lower arm 536*d* to slide in the rightward direction in the elongated hole 511*a* of the clutch control link 511 against the biasing force of the tension spring 517 (FIG. 1, FIG. 3, FIG. 4, FIG. 6 and FIG. 9). Accordingly, by rotating the hand pulley HP fixedly secured to the upper shaft S1 to a timing position of the lowermost position of the upper looper 30 where the looper drive screw gear stopper 503 is fitted into the recessed portion 505*b* of the drive-side gear 505, the clutch control link 511 is moved in the rightward direction due to the biasing force of the tension spring 517 so that the L-shaped distal end portion 501*a* of the clutch changeover link 501 fitted into the moving groove 505*a* of the drive-side gear 505 can move the drive-side gear 505 in the rightward direction. Accordingly, the clutch pawl 505*c* of the drive-side gear 505 is disengaged from the clutch engaging recessed portion 506*a* of the clutch catcher 506 fixedly secured to the lower shaft S2 and hence, the rotational movement of the lower shaft S2 is interrupted so that the drive-side gear 505 cannot be rotated whereby the it becomes possible to shunt the upper looper 30 and the lower looper 40 of the looper drive portion 60 to a given position below the throat plate 8.

Figure 17:
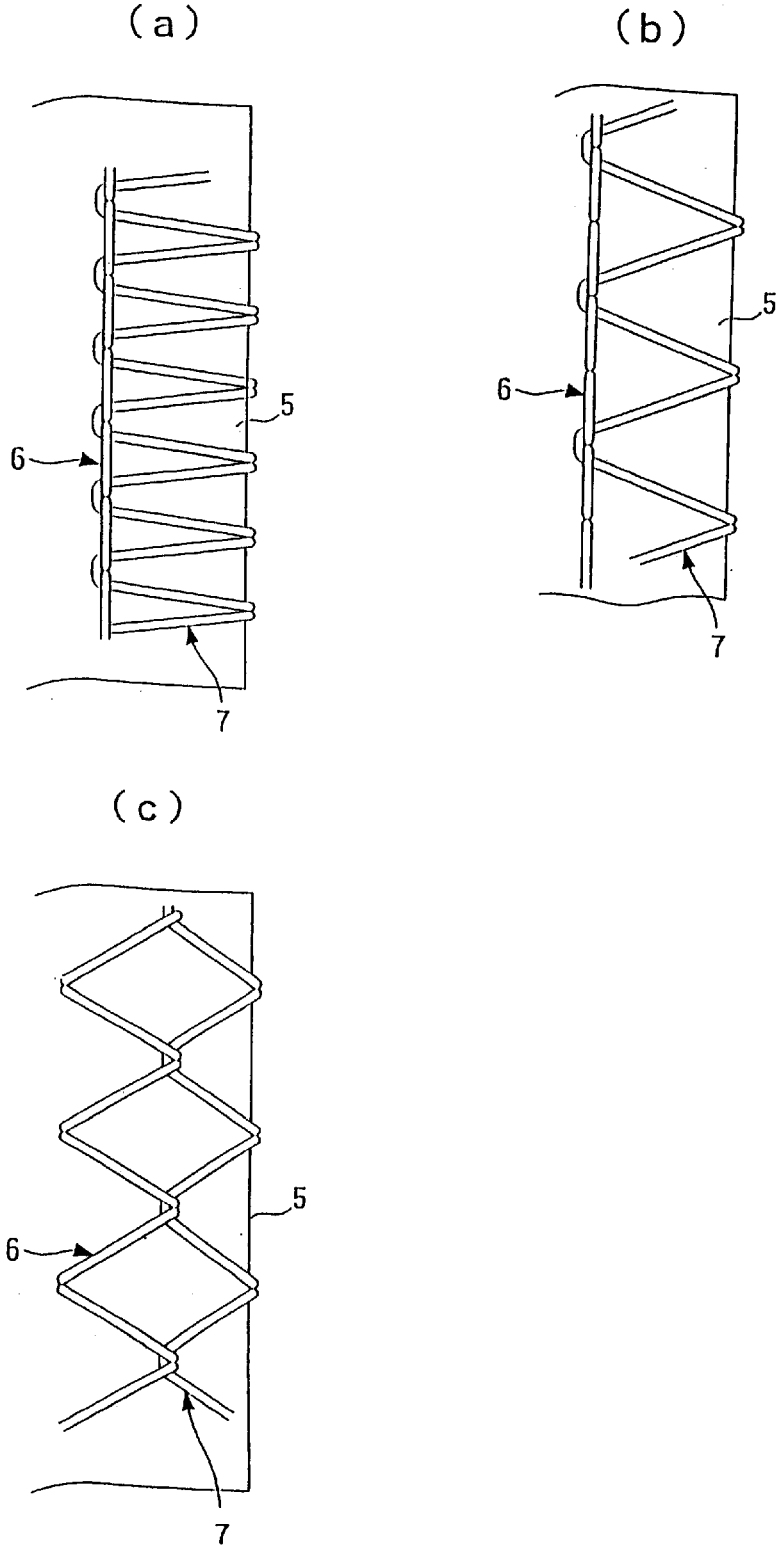
FIG. 17(*a*) and FIG. 17(*b*) are views showing stitches formed by the lockstitch/over-edge stitch sewing machine to which the looper drive mechanism of the sewing machine of the present invention is applied, wherein FIG. 17(*a*) is an explanatory view of a stitch in which an over-edge portion intersects a lockstitch portion every knot, FIG. 17(*b*) is an explanatory view of a stitch in which an over-edge portion intersects a lockstitch portion every one other knot or every other two knots, FIG. 17(*c*) is an explanatory view showing a stitch in which a lockstitch portion is formed in a zigzag shape every stitch or is formed in a polygonal line form every plural stitches.

In the above-mentioned embodiment, although the upper looper thread 3 and the lower looper thread 4 respectively intersect all neighboring lockstitch portions 6, the over-edge portion 7 may intersect every other lockstitch portion 6 as shown in FIG. 17(*b*), for example. In this case, the ratio of rotational speed between the lower shaft S2 and the looper drive portion 60 may be set such that the upper looper 30 and the lower looper 40 perform the motion of one cycle for only one cycle out of two cycles of motion of the needle 10.

Further, although the stitches 1*a*, 2*a* of the upper thread 1 and the lower thread 2 are respectively linear in this embodiment, the stitches may be in a zigzag form every one stitch as shown in FIG. 17(*c*) or may be in a polygonal line every other two or more stitches.

On the other hand, unless the over-edge stitch changeover button BT is pushed, even when the needle stitching transfer arm 536 is biased in the clockwise direction about the stepped screw 537 as the center due to the biasing force of the tension spring 538, the rotation of the upper arm 536*a* of the needle stitching transfer arm 536 is restricted by the holding portion 532*b* of the needle stitching transfer arm holding plate 532. Accordingly, even when the lockstitch is selected by manipulating the stitch changeover knob NB, the security pin 536*b* of the needle stitching transfer arm 536 is not protruded into the recessed portion 527*a* of the needle stitching transfer cam 527 (FIG. 1 and FIG. 3). Further, when other stitching is selected, since the stitch changeover knob NB is manipulated such that such a stitching can be performed and hence, the stitch changeover shaft 111 of the stitch changeover device 110 is rotated to a position where the security pin 536*b* of the needle stitching transfer arm 536 cannot be protruded into the recessed portion 527*a* of the needle stitching transfer cam 527 (FIG. 1 and FIG. 3).

Figure 9:
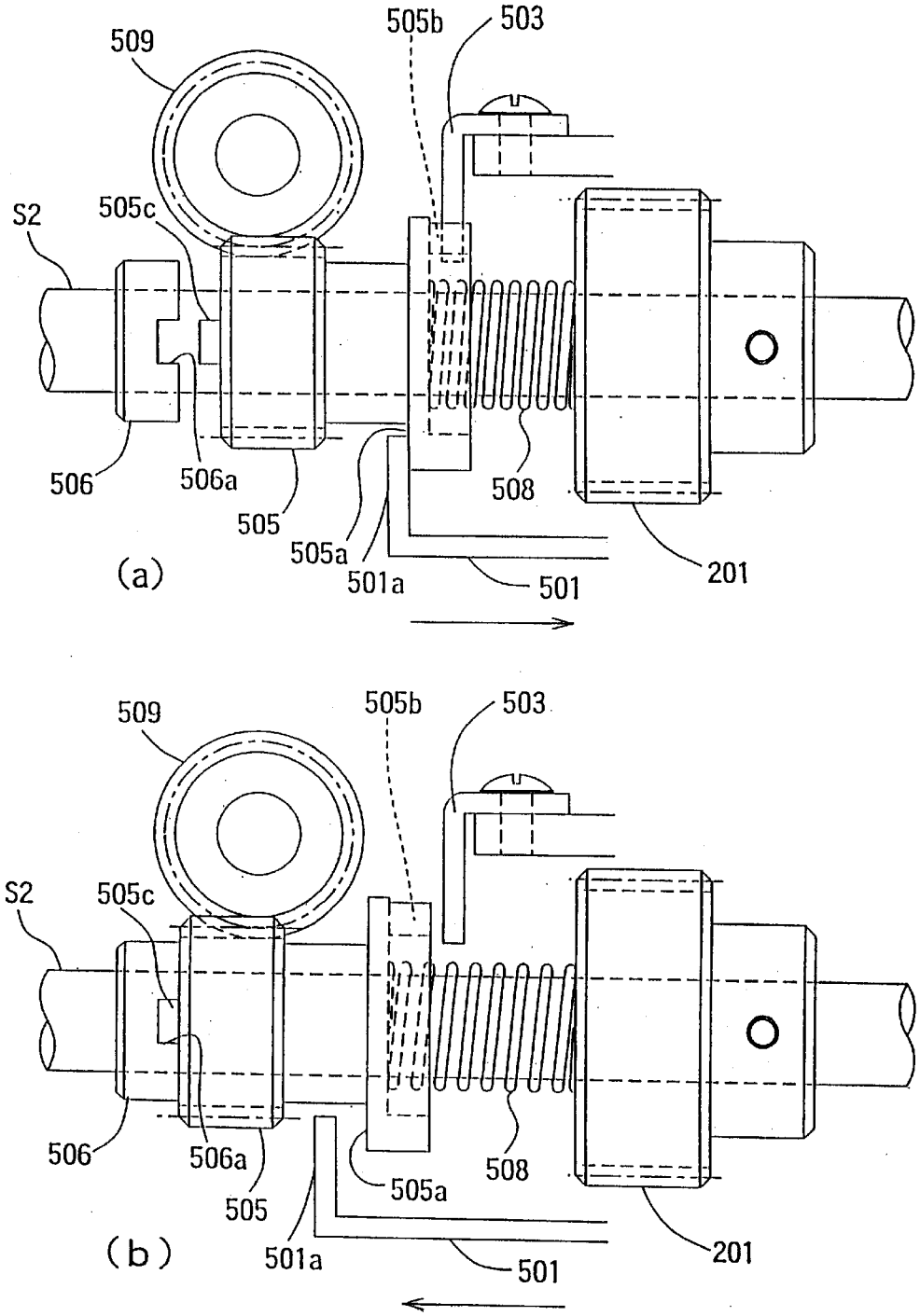
FIG. 9 is an explanatory view showing the operable state of a crutch in the looper drive mechanism of the sewing machine of the present invention, wherein FIG. 9(*a*) is a view showing the state in which power from a lower shaft to a looper drive shaft is interrupted and FIG. 9(*b*) is a view showing the state in which the power is transmitted from the lower shaft to the looper drive shaft.

Accordingly, in such a state, the needle stitch transfer pawl 522 cannot force the needle-bar pulling bar 526 to move in the rightward direction and the clutch changeover link 501 of the clutch control portion 510 is moved in the rightward direction due to the biasing force of the tension spring 517 and hence, the clutch pawl 505*c* of the drive-side gear 505 of the clutch 500 is disengaged from the recessed portion 506*a* of the clutch catcher 506 (FIG. 9(*a*)). Accordingly, the screw gear stopper 503 is engaged with the recessed portion 505*b* of the drive-side gear 505 so as to interrupt the rotational movement of the lower shaft S2 thus preventing the rotation of the drive-side gear 505 whereby the upper looper 30 and the lower looper 40 of the looper drive portion 60 can be shunted to a given position below the throat plate 8.

Further, in the cutter non-operable state shown in FIG. 15 in which only the lockstitch is desired without cutting the fabric edge 5*c* of the fabric 5, the slide plate 744 is lifted or the eccentric cam 90 is rotated by the manipulation knob 91 (FIG. 16) so that the state that the locating locking portion 87 of the lower cutter 73 is fitted into the locating recessed portion 86*a* of the locating plate 86 provided to the throat plate 8 is released and the cutter drive portion 74 is pivotally moved about the pin 765 to take the shunt position in the horizontal state. Accordingly, the longitudinal direction of the elongated groove 85 is directed in the vertical direction and hence, the pin 84 of the drive portion 751 of the clutch 75 only moves in the elongated groove 85 of the driven portion 741 with a play so that the transmission of the power to the upper cutter 72 can be interrupted.

In this manner, with the simple manipulation to pivotally move the cutter drive portion 74 to the shunt position in the horizontal state, the stitching operation can be changed over to the operation which performs only the lockstitching without cutting the fabric edge 5*c* of the fabric 5.

According to the preferred embodiment to which the looper and cutter drive mechanisms of sewing machine of the present invention is applied to the lockstitch/over-edge sewing machine, the horizontal rotary hook which performs the horizontal rotational movement is used. However, the present invention is not limited to such a rotary hook and any rotary hook may be used so long as the rotary hook can make the upper thread and the lower thread interlace each other when elevating the upper thread which is made to pass through the needle from the lowermost position of the needle thus forming the lockstitch portion made of stitches parallel to the surface of the work and the stitches perpendicular to the surface of the work.

Further, the cutter drive mechanism 70, the needle stitching control portion 520, the clutch 500 and the clutch control portion 510 are not limited to the above-mentioned structures. So long as the cutter drive mechanism 70 can perform stitching while changing over the operation which performs lockstitching after cutting the fabric edge and the operation which performs lockstitching without cutting the fabric edge, the needle stitching control portion 520 shifts the needle stitching position in an interlocking manner with the manipulation of the over-edge stitching changeover button BT, the clutch 500 enables the formation of the lockstitch portion 6 and the over-edge stitch portion 7 at the time of forming over-edge stitch portion 7 and the formation of only the lockstitch portion 6 at the time of forming the lockstitch portion 6, and the clutch control portion 510 can control the clutch 500 in an interlocking manner with the stitch changeover knob NB, any structures can be used.

Further, the looper drive portion 60 is not limited to the above-mentioned structure. So long as the looper drive portion 60 has a constitution in which the upper looper 30 and the lower looper 40 are respectively disposed below the throat plate 8, respective loop-taker points 31, 41 thereof are arranged in the same direction such that the loop-taker points 31, 41 pass a frontal side of the needle 10 as seen in the stitching direction, the upper looper 30 and the lower looper 40 are driven such that the upper looper 30 and the lower looper 40 perform movements having traces on planes substantially parallel to each other, the upper looper thread 3 which is made to pass through the upper looper 30 which performs the reciprocating movement drawing the arcuate trace which intersects the trace of the needle 10 above the throat plate 8 and passes through the throat plate 8 is intercepted by the needle 10 descending from the uppermost position when the upper looper 30 is descended from an uppermost position, the lower looper thread 4 which is made to pass through the lower looper 40 which performs the reciprocating movement drawing the trace L40 which intersects the trace L10 of the needle 10 and the trace L30 of the upper looper 30 below the throat plate 8 is intercepted by the descending needle 10 below the throat plate 8 when the lower looper 40 is moved from one end to the other end of the trace L40, and the lower looper thread 4 is intercepted by the upper looper 30 elevating from the lowermost position when the lower looper 40 is moved to the other end, whereby the upper looper thread 3 and the lower looper thread 4 are interlooped each other at the edge portion 5*c* of the work 5 and, at the same time, the upper looper thread 3 is interlooped with the lockstitch portion 6 through an upper surface 5*a* of the work 5, and the lower looper thread 4 is interlooped with the lockstitch portion 6 through a lower surface 5*b* of the work 5 thus forming the over-edge stitch portion 7, the looper drive portion 60 can adopt any structure.

Figure 18:
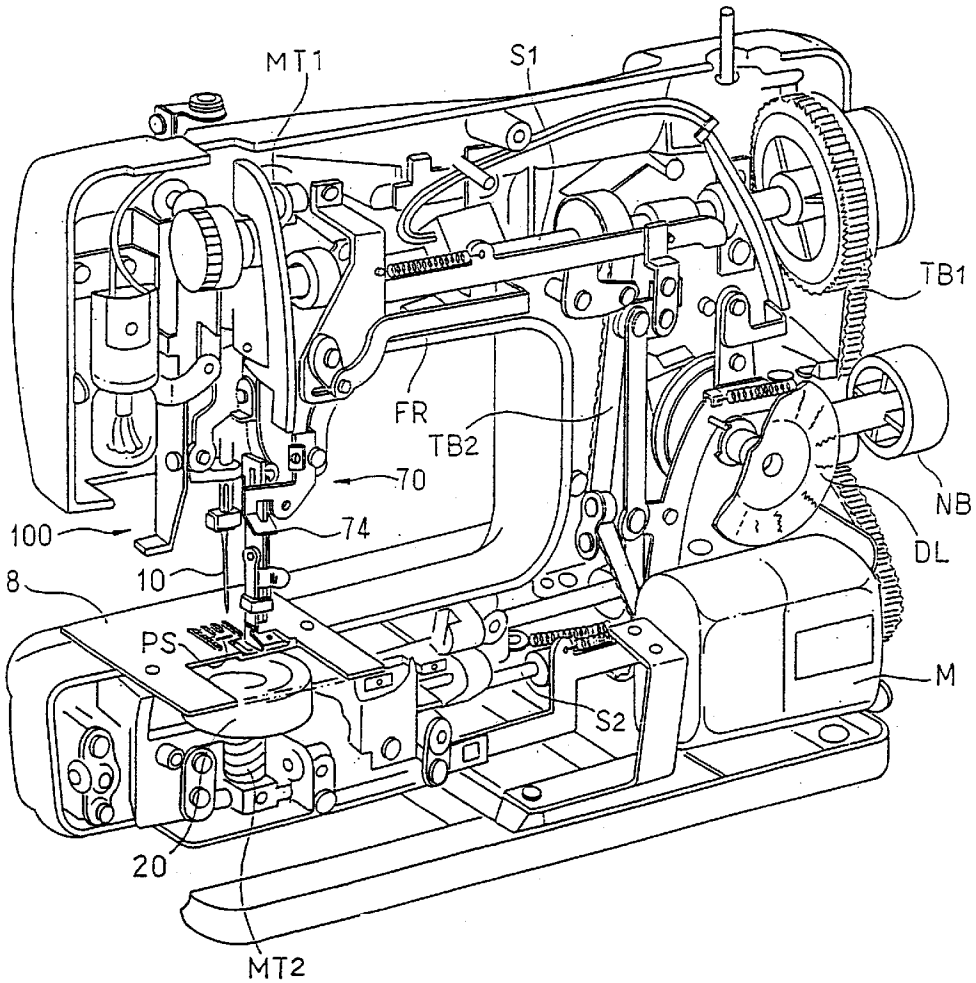
FIG. 18 is a perspective view showing an embodiment of a lockstitch sewing machine to which a cutter drive mechanism of the sewing machine of the present invention is applied.
Figure 19:
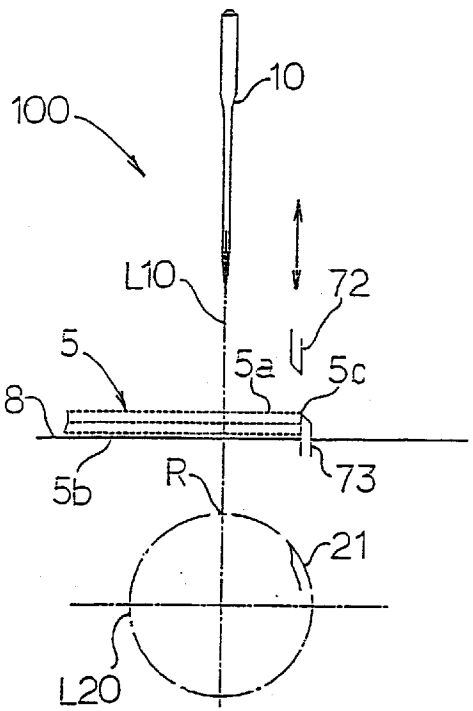
FIG. 19(*a*) and FIG. 19(*b*) are explanatory views simply showing the operation of the lockstitch sewing machine to which the cutter drive mechanism of the present invention is applied.
Figure 19:
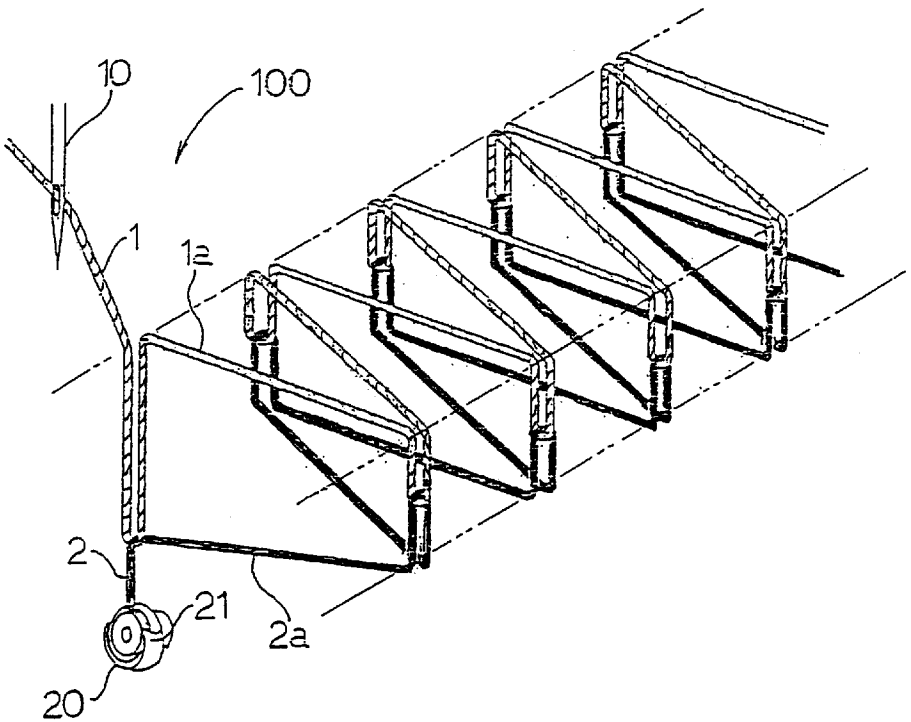
Figure 20:
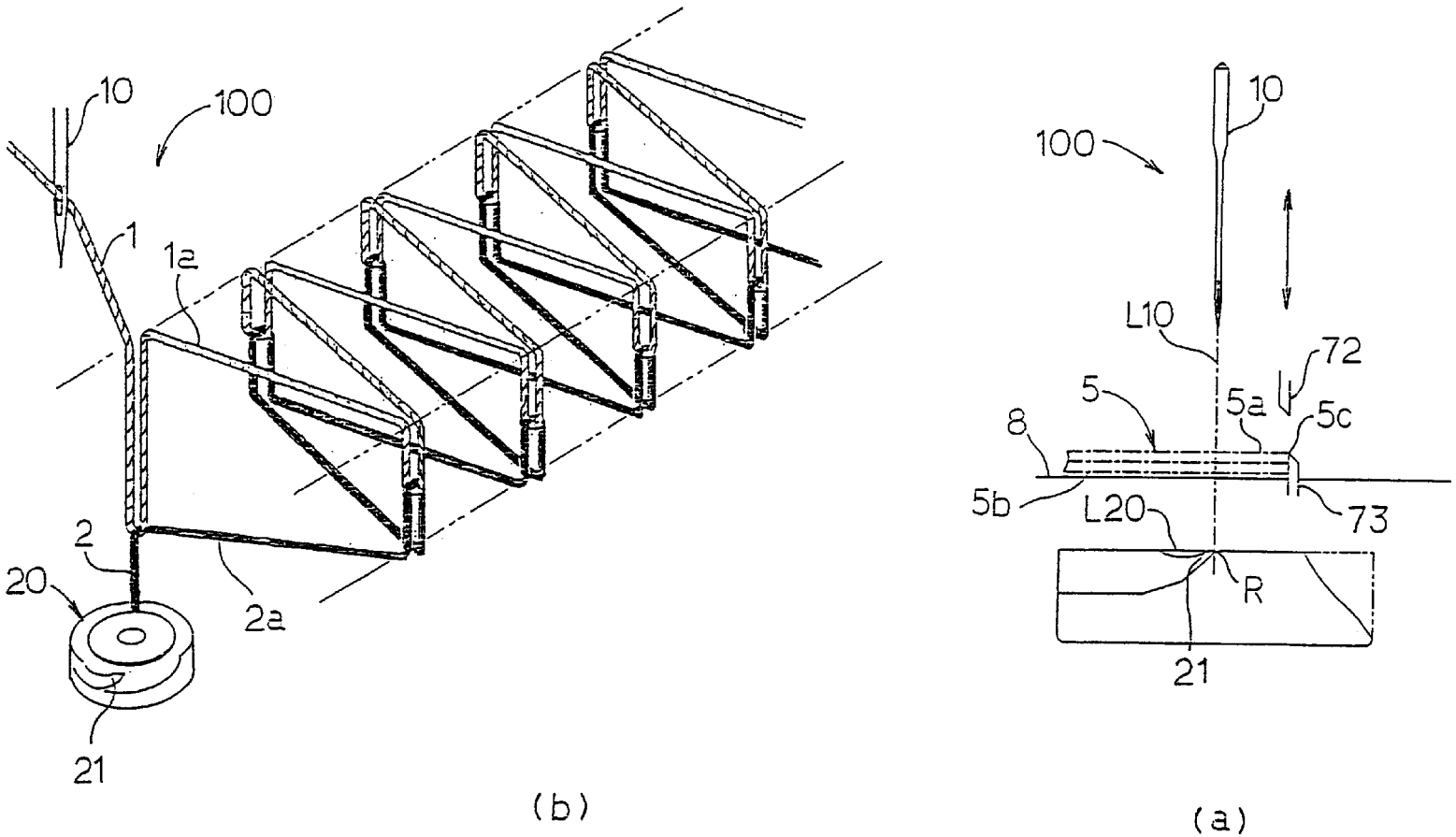
FIG. 20(*a*) and FIG. (*b*) are explanatory views simply showing the operation of the lockstitch sewing machine to which the cutter drive mechanism of the sewing machine of the present invention is applied.

Further, the cutter drive mechanism of the sewing machine of the present invention is applicable to a lockstich sewing machine shown in FIG. 18 which is not provided with the above-mentioned looper drive mechanism 50. In this case, as shown in FIG. 19 and FIG. 20, the needle 10 through which the upper thread is made to pass performs the upward and downward movement drawing a trace L10 in the vertical direction to a throat plate 8 corresponding to the rotation of an upper shaft S1. As in the case of the conventional lockstiching, the lockstitching is performed such that the upper thread 1 which is made to pass through the needle 10 penetrates a fabric 5 following the upward and downward movement of the needle 10 and thereafter a loop-taker point 21 of a rotary hook 20 intercepts an upper thread 1 at a point R when the needle 10 starts to elevate from the lowermost position along with the rotation of the lower shaft S2 which is in synchronism with the upper shaft S1 so as to make the upper thread 1 and a lower thread 2 interlace with each other, and further, the lower thread 2 is pulled up when the upper thread 1 is pulled up by the needle 10 which further returns upwardly and a looper thread take-up 730 (FIG. 11), whereby the upper thread 1 and the lower thread 2 respectively form stitches 1*a*, 2*a* on an upper surface 5*a* and a lower surface 5*b* of the work, for example, the fabric 5 having a two-plied structure which are parallel to the fabric surface, and the upper thread 1 and the lower thread 2 are made to interlace each other in the vertical direction of the fabric 5, for example, at the center in the thickness-wise direction thus forming the stitch which penetrates the fabric 5 and hence, by repeating the above-mentioned operation every one stitch feed, the continuous lockstitch portion 6 is formed.

Figure 21:
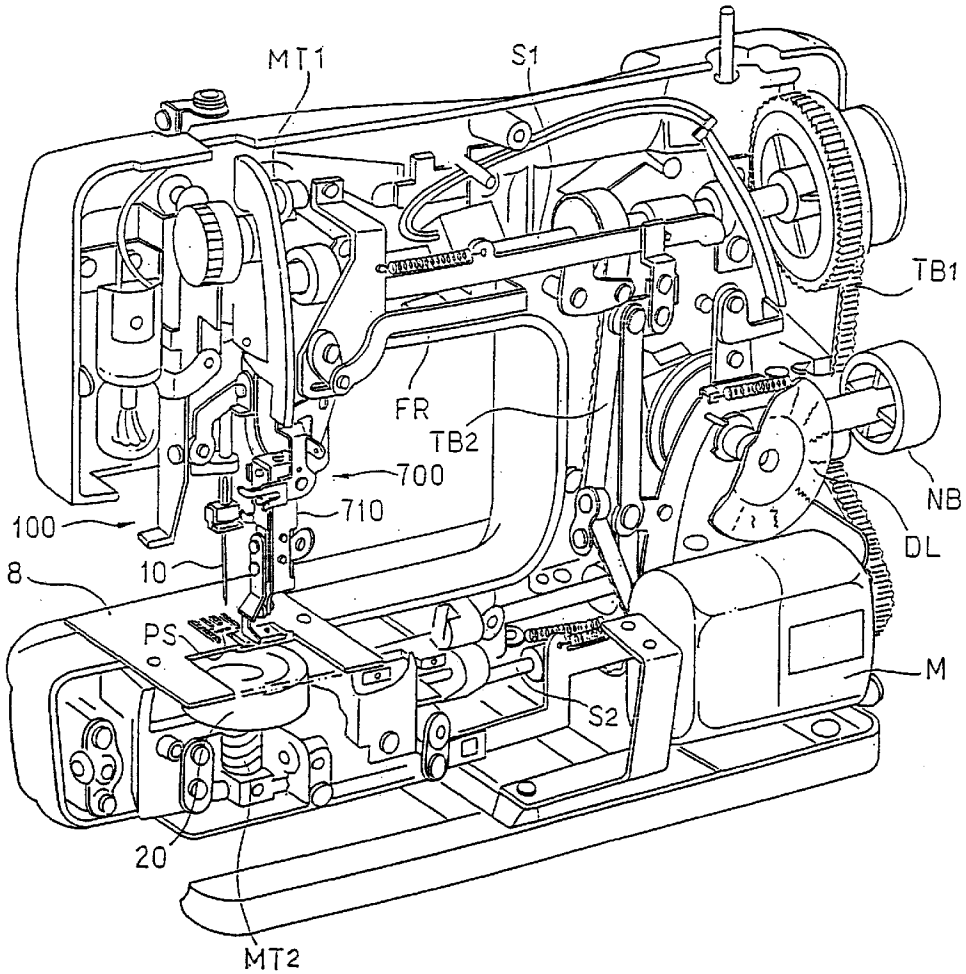
FIG. 21 is a perspective view showing an embodiment of a lockstitch sewing machine to which a cutter drive mechanism of the sewing machine of the present invention is applied.

Further, the cutter drive mechanism of the sewing machine of the present invention is not limited to the above-mentioned cutter drive mechanism 70 and may be a cutter drive mechanism 700 shown in FIG. 21.

This cutter drive mechanism 700, as in the case of the above-mentioned cutter drive mechanism 70, cuts a fabric edge 5*c* of a fabric 5 (FIG. 2, FIG. 19, FIG. 20) by an upper cutter 72 which performs the upward and downward movement by way of a motion transfer mechanism 71 (FIG. 22, FIG. 11) which is operated in an interlocking manner with an upper shaft S1 and a lower cutter 73 which is operated in a cooperative manner with the upper cutter 72.

The cutter drive mechanism 700 of the lockstitch sewing machine is provided with a cutter drive portion 710 (FIG. 21, FIG. 22) which is supported on a frame FR and slidably guides the upper cutter 72.

The motion transfer mechanism 71 is connected with the upper cutter 72 by way of a clutch 750 (FIG. 22) which transmits power to the upper cutter 72 at the time of cutting operation of the cutter drive portion 710 and pivotally moves the cutter drive portion 710 to a shunting position and interrupts the transmission of the power at the time of non-cutting operation of the cutter drive portion 710.

The motion transfer mechanism 71 has been explained heretofore in conjunction with FIG. 1, FIG. 10, FIG. 11 and FIG. 12 and hence, the explanation thereof are omitted here.

Figure 22:
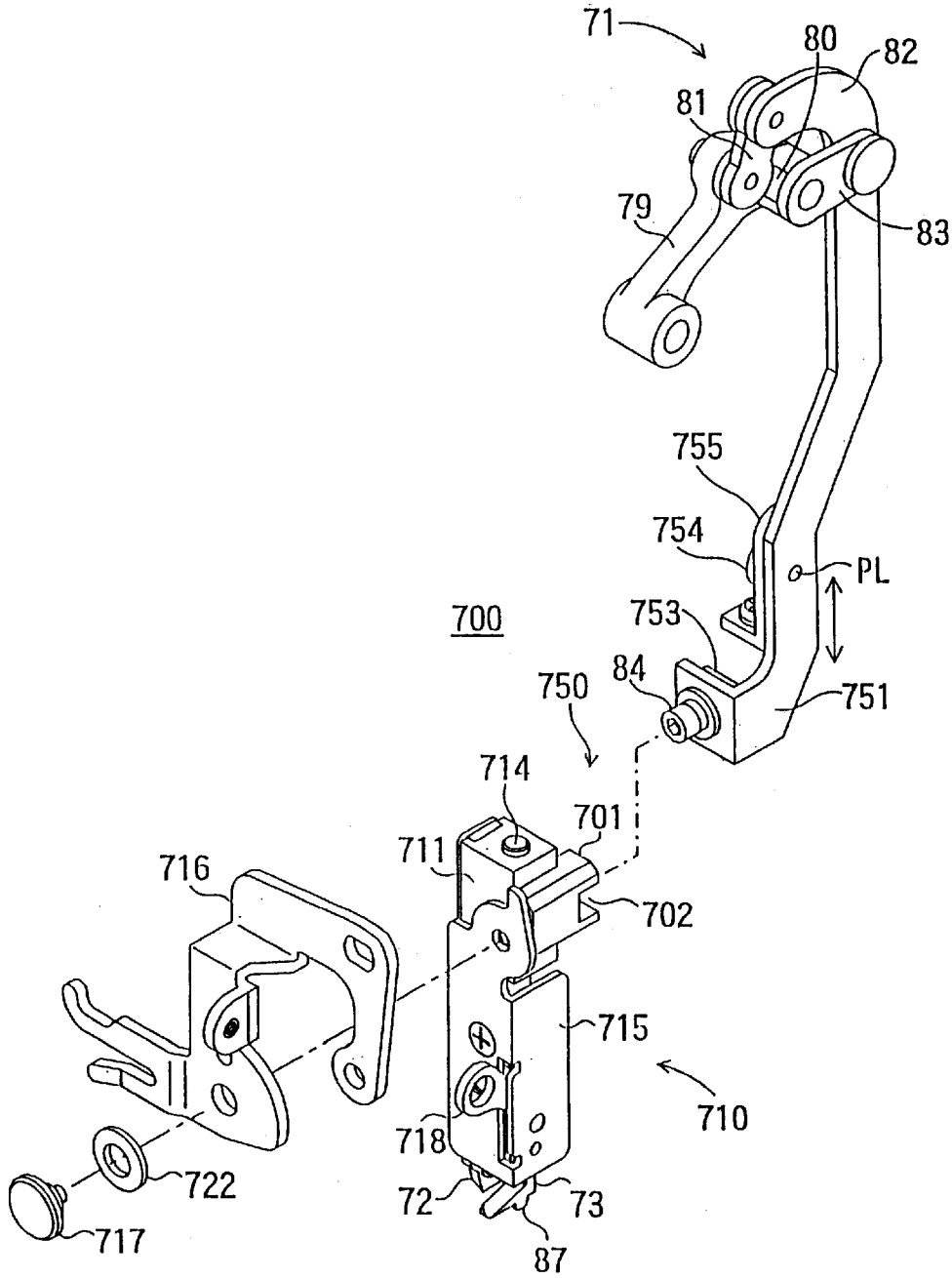
FIG. 22 is an exploded perspective view showing a motion transfer mechanism and a cutter drive portion in the cutter drive mechanism of the sewing machine of the present invention.

The clutch 750 includes, as shown in FIG. 22, includes a pin 84 which is formed as a drive portion 751 on one link 82 and an elongated groove 702 which is formed in the upper cutter 72 as a driven portion 701 and into which the pin 84 is fitted. The pin 84 is threadedly mounted in a mounting hole 752 (FIG. 13) formed in a lower bent end portion of the other link 82 which constitutes a drive portion 751 using a nut 753.

Figure 23:
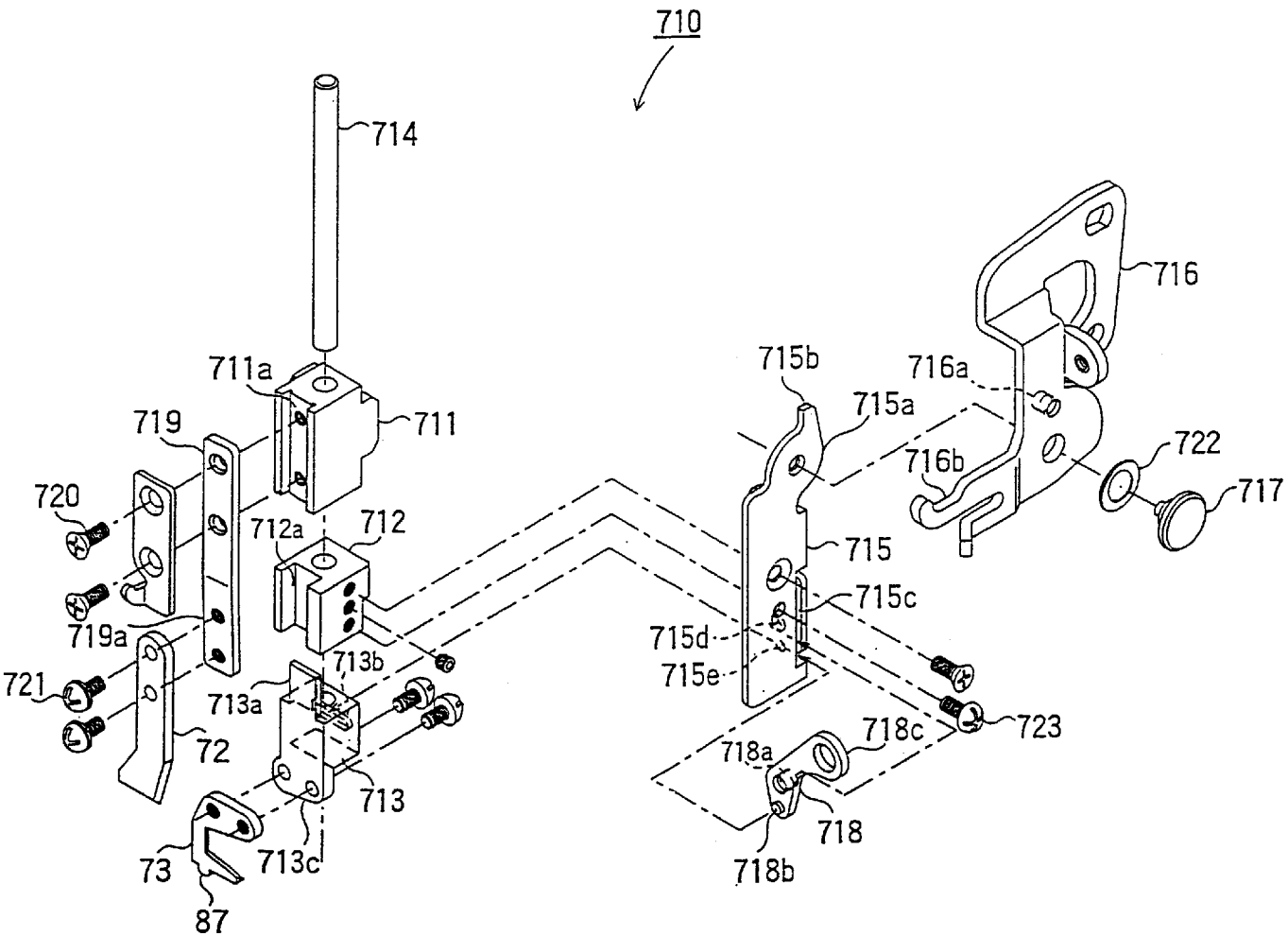
FIG. 23 is an exploded perspective view showing a cutter drive portion in the cutter drive mechanism of the sewing machine of the present invention.

As shown in FIG. 23, the cutter drive portion 710 includes an upper cutter drive block 711 which is provided with an elongated groove 702 (FIG. 22) into which the pin 84 of the drive portion 751 is fitted and to which the upper cutter 72 is fixedly secured, a cutter slide body 712 disposed parallel with the upper cutter drive block 711, a lower cutter mounting block 713 which is disposed parallel to the cutter slide body 712 and to which the lower cutter 73 is fixedly secured, and a cutter slide shaft 714 on which these three parts are slidably fitted on in the order of the upper cutter drive block 711, the cutter slide body 712 and the lower cutter mounting block 713 from above, wherein the upper cutter 72 and the lower cutter 73 are arranged such that they can cut the fabric.

The cutter slide body 712 is provided with a guide groove 712*a* in which a protrusion 713*a* formed on the lower cutter mounting block 713 is slidably fitted in the axial direction of the cutter slide shaft 714. Further, a cutter unit base 715 which rotatably fix the cutter drive portion 710 per se to the frame FR is fixedly secured the cutter slide body 712. To be more specific, on a cutter unit base mounting plate 716 which is fixedly secured to the frame FR by bolts or the like, an upper portion 715*a* of the cutter unit base 715 is rotatably mounted by a caulking stepped pin 717 or the like, for example. This stepped pin 717 is inserted from the cutter unit base mounting plate 716 side by way of a spring washer 722 such as wave-shaped spring washer or the like and can control the rotation of the cutter unit base 715 when the base 715 is rotated. Further, a stopper 715*b* is formed on an upper end portion of the cutter unit base 715 and a protrusion 716*a* is formed on a cutter unit base 715 mounting side of the cutter unit base mounting plate 716. Due to such a constitution, when the cutter unit base 715 is rotated from the horizontal direction which constitutes a shunting position to the vertical downward direction, the further rotation of the cutter unit base 715 is prevented. Still further, the cutter unit base 715 is bent in an L-shape such that the cutter unit base 715 can cover the cutter slide body 712 and given two neighboring surfaces of the cutter slide body 712 and the lower cutter mounting block 713. Here, the cutter slide body 712 is fixedly secured to the cutter slide shaft 714 by thread members such as small bolts.

The lower cutter mounting block 713 is provided with a groove portion 713*b* and this groove portion 713*b* is engaged with a locating lever 718 which is loosely fitted in a slit 715*c* formed in a bent portion of the cutter unit base 715 which is fixedly secured to the cutter slide body 712. To be more specific, the locating lever 718 is provided with a semi-pressed protrusion 718*a* which constitutes a rotary shaft used as a fulcrum and the protrusion 718*a* is pivotally supported in a pivotally mounting hole 715*d* formed in the cutter unit base 715. Further, a protrusion 718*b* which constitutes a load point is formed on one end of the locating lever 718 and the protrusion 718*b* is engaged with a groove portion 713*b* of the lower cutter mounting block 713. Accordingly, the locating lever 718 is gripped between the cutter unit base 715 and the lower cutter mounting block 713 and hence, by manipulating and rotating a manipulating portion 718*c* which is formed at the other end of the locating lever 718 and becomes a point of force of the locating lever 718 upwardly, the lower cutter mounting block 713 is descended while sliding along the cutter slide shaft 714. On the other hand, by rotating the manipulating portion 718*c* downwardly, the lower cutter mounting block 713 is ascended or elevated while sliding along the cutter slide shaft 714. A stopper recessed portion 718*c* is formed on a back surface of the protruding portion 718*b* of the locating lever 718. When the locating lever 718 is manipulated upwardly such that the lower cutter 73 is descended to a given position, a stopper protrusion 715*e* which is formed on the cutter unit base 715 in a protruding manner is fitted into the stopper recessed portion 718*c*.

Figure 25:
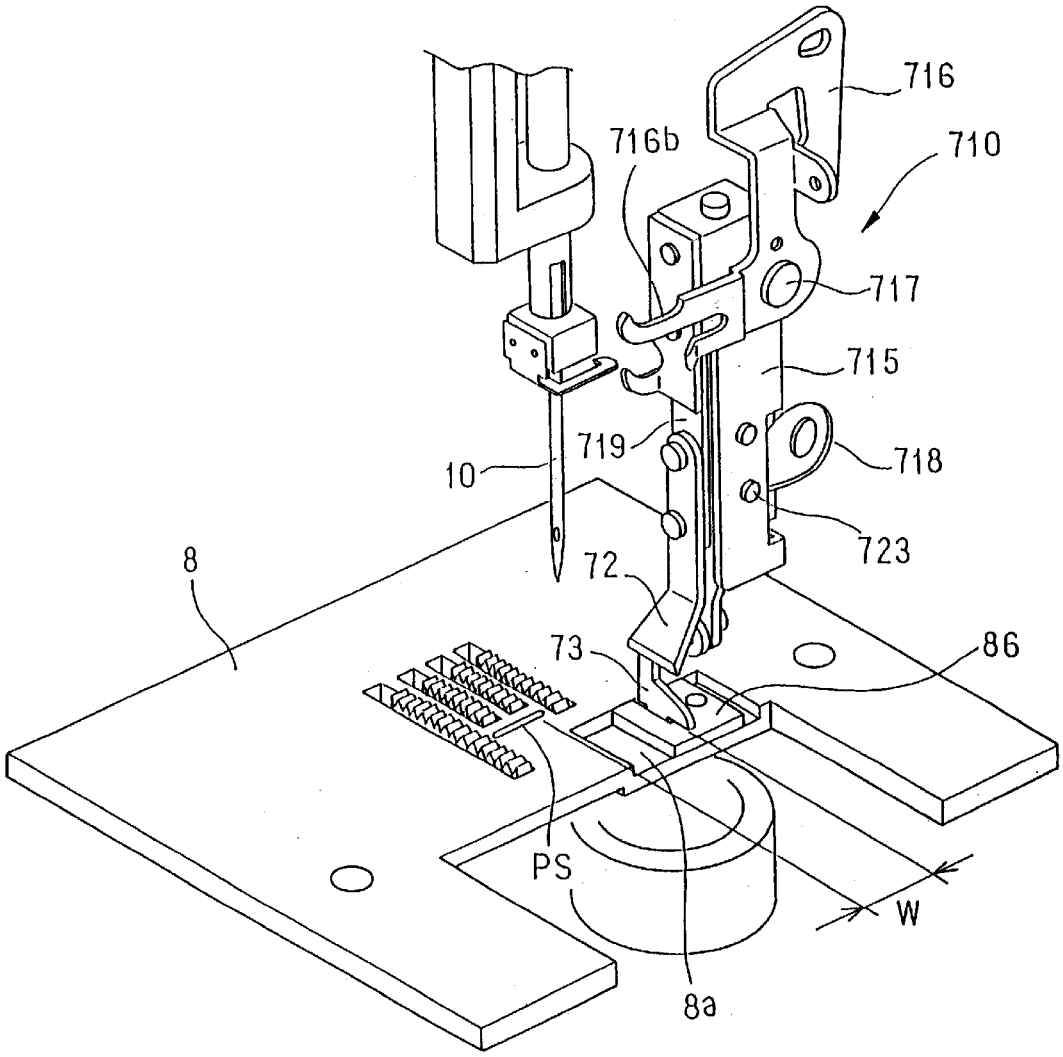
FIG. 25 is a perspective view showing the cutter operable state in the cutter drive mechanism of the sewing machine of the present invention.
Figure 26:
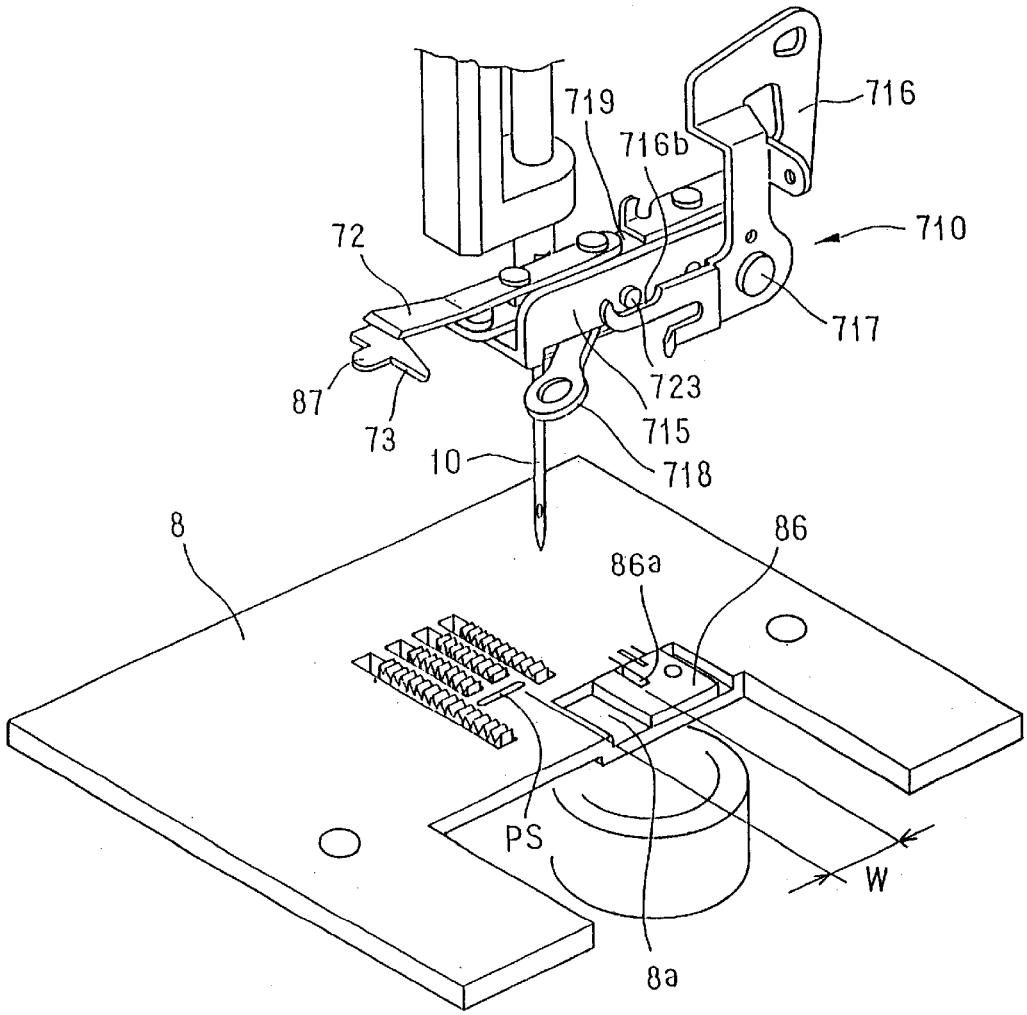
FIG. 26 is a perspective view showing the cutter non-operable state in the cutter drive mechanism of the sewing machine of the present invention.
Figure 27:
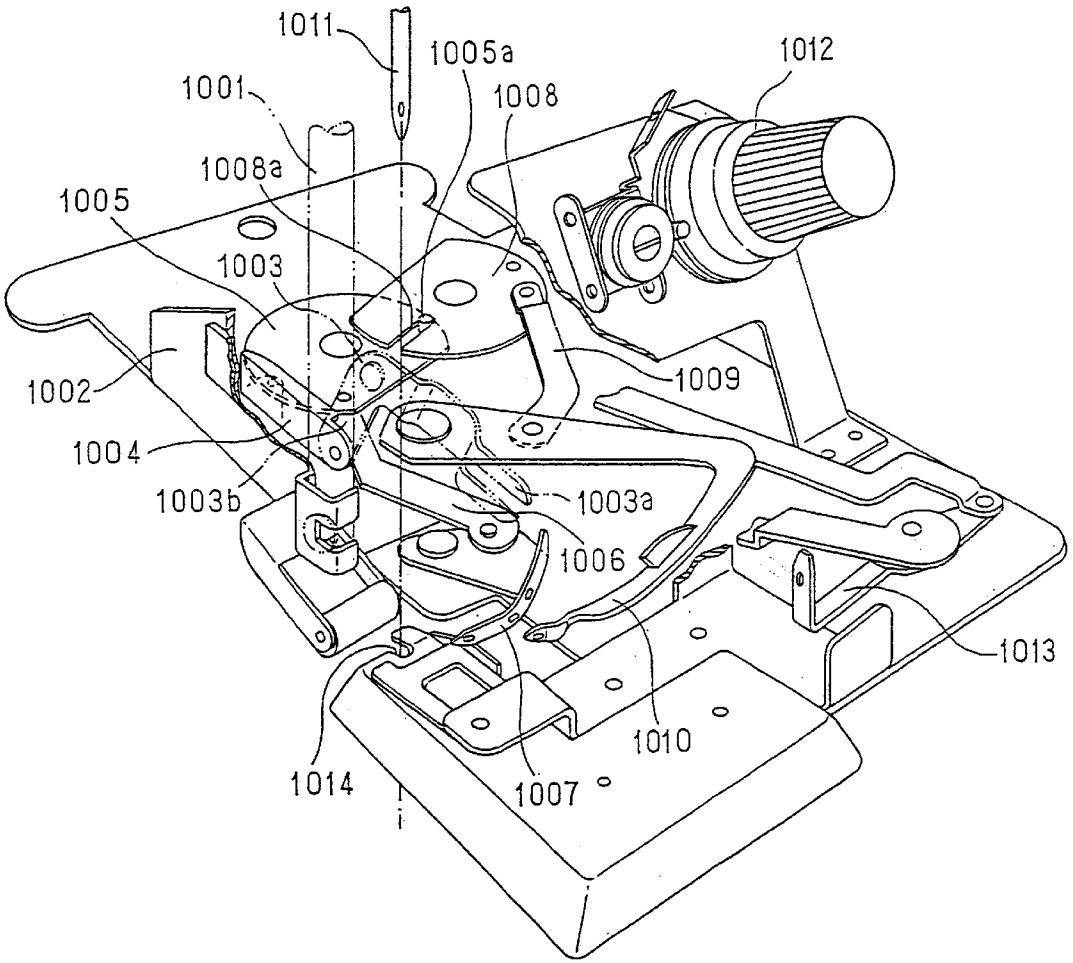
FIG. 27 is a perspective view showing a constitution of a lockstitch/over-edge stitch attachment which is mounted on and used in the lockstitch sewing machine.

The lower cutter 73 fixedly secured to the lower end portion 713*c* of the lower cutter mounting block 713 includes, as in the case of the above-mentioned cutter drive mechanism 70, a locating locking-portion 87 which locates the cutter drive portion 710 to a locating recessed portion 86*a* of a locating plate 86 provided to the throat plate 8 to a needle stitching position PS of the needle 10 at the time of operating cutters (FIG. 25, FIG. 26). The locating plate 86 provided with the locating recessed portion 86*a* is constituted such that the position of the locating plate 86 can be adjusted in the leftward and rightward direction so as to change the stitching width W to the needle stitching position PS. That is, the locating plate 86 is incorporated in the throat plate 8 such that the position of the locating plate 86 can be adjusted in the leftward and rightward direction, wherein the position of the locating plate 86 can be adjusted in the stitch width W direction to the recessed portion 8*a* formed in the throat plate 8. After being located, the locating plate 86 is fixedly secured to the throat plate 8 by bolts or the like.

On the other hand, the upper cutter drive block 711 includes a groove portion 711*a* and an upper cutter spring plate 719 is fitted in the groove portion 711*a* and is fixedly secured thereto by thread members 720 such as bolts. This upper cutter spring plate 719 is formed to have a length which allows the upper cutter spring plate 719 extended from the upper cutter drive block 711 and is slidably and loosely fitted in a guide groove 712*a* formed in the cutter slide body 712. Using thread members 721 such as bolts, the upper cutter 72 is fixedly secured to a portion 719*a* of the upper cutter spring plate 719 extended from the upper cutter drive block 711. The extended portion 719*a* of the upper cutter spring plate 719 is bent so as to make the upper cutter 72 press the lower cutter 73 by positively applying a biasing force of the upper cutter spring plate 719.

Figure 24:
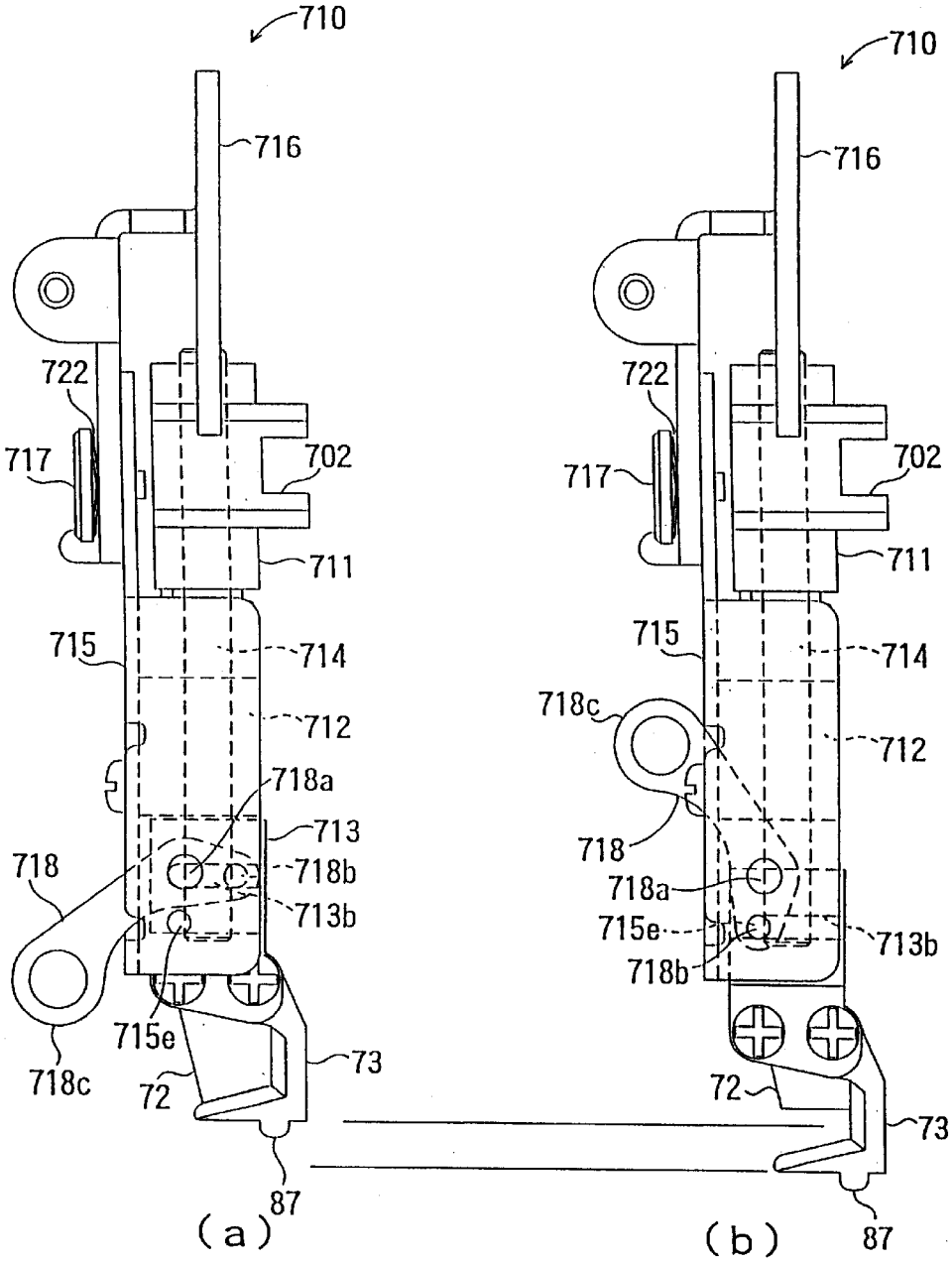
FIG. 24 is an explanatory view showing the operation of the cutter drive portion in the cutter drive mechanism of the sewing machine of the present invention.

In the lockstitch sewing machine having such a constitution, at the time of performing the over-edge stitching in the lockstitching by cutting the fabric edge, as shown in FIG. 24(*a*), when the locating lever 718 of the cutter drive portion 710 is descended to a given position and the lower cutter 73 takes a non-operable state in which the lower cutter 73 is shunted in the shunting position by the lower cutter mounting block 713, the locating lever 718 is manipulated upwardly as shown in FIG. 24(*b*). Due to such a manipulation, the lower cutter 73 which is fixedly secured to the lower cutter mounting block 713 having the groove portion 713*b* in which the protrusion 718*b* of the locating lever 718 is fitted is descended so that the locating locking portion 87 of the lower cutter 73 is fitted in the locating recessed portion 86*a* of the locating plate 86 provided to the throat plate 8 so that the cutter operable state (FIG. 25) in which the cutter drive portion 710 is located to the needle stitching position PS of the needle 10 can be established. Here, since the stopper protruding portion 715*e* formed on the cutter unit base 715 in a protruding manner is replaceably fitted in the stopper recessed portion 718*c* formed in the locating lever 718 by a given force, the return of the locating lever 718 can be prevented.

In this cutter operable state, as shown in FIG. 19 and FIG. 20, the needle 10 through which the upper thread 1 is made to pass performs the upward and downward movement drawing the trace L10 in the vertical direction to the throat plat e 8 along with the rotation of the upper shaft S1. In the lockstitching, in the same manner as the conventional lockstitching, the upper thread 1 which is made to pass through the needle 10 penetrates a fabric 5 following the upward and downward movement of the needle 10 and thereafter a loop-taker point 21 of a rotary hook 20 intercepts an upper thread 1 along with the rotation of the lower shaft S2 which is in synchronism with the upper shaft S1 at a point R when the needle 10 starts to elevate from the lowermost position so as to make the upper thread 1 and a lower thread 2 interlace with each other, and further, the lower thread 2 is pulled up when the upper thread 1 is pulled up by the needle 10 which further returns upwardly and a looper thread take-up 730 (FIG. 11), whereby the upper thread 1 and the lower thread 2 respectively form stitches 1*a*, 2*a* on an upper surface 5*a* and a lower surface 5*b* of the work, for example, the fabric 5 having a two-plied structure which are parallel to the fabric surface, and the upper thread 1 and the lower thread 2 are made to interlace each other in the vertical direction of the fabric 5, for example, at the center in the thickness-wise direction thus forming the stitch which penetrates the fabric 5 and hence, by repeating the above-mentioned operation every one stitch feed, the continuous lockstitch is formed.

Further, the rotational movement of the rotary shaft of the sewing machine, for example, the upper shaft S1 in the drawing is transferred to the upward and downward movement by way of the motion transfer mechanism 71 (FIG. 21, FIG. 22, FIG. 11 and FIG. 12) which is operated in an interlocking manner with the above-mentioned rotational movement. That is, when the upper shaft S1 is rotated, the first quadric crank chain LK1 is rocked wherein the links 77, 78 are used as cranks and the link 80 is used as a connecting rod and the link 79 is used as a rocker arm. By the rocking of the link 79, the link 81 of the second quadric crank chain LK2 is rocked and the link 82 and accordingly the drive portion 751 of the clutch 75 performs the upward and downward movement. Here, the motion trace of the link 82 draws an elliptical trace due to the quadric crank chain mechanisms LK1, LK2 and draws an approximate straight line in the vertical direction at a PL point in the vicinity of the drive portion 751 so that the reaction from the cutter drive portion 74 is supported by a guide pin 754 held at the PL point of the link 82 which passes through an elongated guide hole 755*a* formed in the guide plate 755 fixedly secured to the frame FR. Due to such a constitution, the motion of the drive portion 751 in the lateral direction is restricted and only the upward and downward motion can obtain a stroke t (FIG. 11) per one rotation of the upper shaft S1.

The upward and downward motion obtained by the motion transfer mechanism 71 is transmitted to the upper cutter 72 by way of the pin 84 of the drive portion 751 of the clutch 750 and the elongated groove 702 in which the pin 84 of the upper cutter drive block 711 of the cutter drive portion 710 which constitutes the driven portion 701 is fitted. In the cutter operable state (FIG. 25) in which the locating locking portion 87 of the lower cutter 73 is fitted into the locating recessed portion 86*a* of the locating plate 86 provided to the throat plate 8 so that the cutter drive portion 710 is located to the needle stitching position PS of the needle 10, the upper cutter 72 is slidably guided by the guide groove 712*a* of the cutter slide body 712 by way of the upper cutter spring plate 719 using the upper cutter drive block 711 of the cutter drive portion 710 which is pivotally mounted on the frame FR. In this cutter operable state, the cutter drive portion 710 is held in the vertical state around the stepped pin 16 and the longitudinal direction of the elongated hole 702 is directed in the horizontal direction, the pin 84 of the drive portion 751 of the clutch 750 and the elongated groove 702 of the driven portion 701 allow the power transmission and hence, the power is transmitted to the upper cutter 72 at the time of performing the cutter operation of the cutter drive portion 710. Accordingly, the fabric edge 5*c* of the fabric 5 is cut by the upper cutter 72 which performs the upward and the downward movement and the lower cutter 73 which is cooperatively operated with the upper cutter 72.

In this manner, by performing the zigzag stitching or the like while cutting the fabric edge 5*c* of the fabric 5, it becomes possible to perform the over-edge stitching simultaneously with the lockstitching.

Here, in the cutter non-operable state in which only the lockstitching is desired without cutting the fabric edge 5*c* of the fabric 5, as shown in FIG. 24(*a*) and FIG. 26, the locating lever 718 is manipulated downwardly. Accordingly, the state that the lower cutter 73 fixedly secured to the lower cutter mounting block 713 is elevated and the locating locking portion 87 of the lower cutter 73 is fitted in the locating recessed portion 86*a* of the locating plate 86 provided to the throat plate 8 is released. By pivotally moving the cutter drive portion 710 about the stepped pin 717 to the shunting position in the horizontal state by manipulating the same locating lever 718, the longitudinal direction of the elongated groove 702 is directed in the vertical direction and hence, the pin 84 of the drive portion 751 of the clutch 750 only moves in the elongated hole 702 of the driven portion 701 with a play and the transmission of power to the upper cutter 72 is interrupted. Further, when the cutter drive portion 710 is pivotally moved, a screw 723 having a pan-shaped head which fixedly secures the cutter slide body 712 to the cutter unit base 715 impinges on the cutter unit base mounting plate 716, and the cutter unit base 715 is inclined by the attenuating function of a spring washer 722 for braking and gets over the cutter unit base mounting plate 716 and then is fitted into a recessed portion 716*b* formed in the cutter unit base mounting plate 716. Accordingly, the cutter drive portion 710 is semi-fixedly secured and hence, it becomes possible to prevent the downward displacement of the cutter drive portion 710 due to the vibration or the like generated by the sewing machine.

In this manner, with the simple manipulation of the locating lever 718 which is required only to pivotally move the cutter drive portion 710 from the cutter operable position in the vertical state to the cutter shunting position in the horizontal state, the operation can be changed over to an operation to perform only the lockstitching without cutting the fabric edge 5*c* of the fabric 5.

The cutter drive portion of the cutter drive mechanism of the sewing machine according to the present invention is not limited to the above structure and any structure can be used so long as the structure allows the slidable mounting of the lower cutter and is provided with a locating lever which fits the locating locking portion into the locating recessed portion of the throat plate at the time of performing the cutting operation.

Industrial Applicability

As has been explained heretofore, according to the looper drive mechanism of the sewing machine of the present invention, the upper looper and the lower looper are respectively disposed below the throat plate, respective loop-taker points thereof are arranged in the same direction such that the loop-taker points pass a frontal side of the needle as seen in the stitching direction, the upper looper and the lower looper can be driven such that the upper looper and the lower looper perform movements having traces on planes substantially parallel to each other, whereby the looper drive mechanism has both of the lockstitching function and the over-edge stitching function. Further, it becomes possible to firmly stitch a plurality of fabrics and to simultaneously perform the over-edge stitching of edge portions of these fabrics. Still further, the labor and cost incurred by the stitching can be minimized.

Further, according to the looper drive mechanism of the sewing machine of the present invention, the lockstitch and the over-edge stitch can be individually formed with the use of a needle and two loopers and hence, the stitch of the present invention can be realized easily and at a low cost with a single sewing machine. Further, in this case, the alteration of stitch from such a stitch to other stitch can be easily performed with an extremely small change.

Further, the clutch can be changed over such that the clutch forms the lockstitch portion and the over-edge portion by transmitting power from the lower shaft to the looper drive shaft at the time of forming the over-edge portion and forms the lockstitch portion by shunting the upper looper at the lowermost position and interrupting the transmission of power from the lower shaft to the looper drive shaft at the time of forming the lockstitch portion. Accordingly, the labor and time necessary for individually performing the lockstitching and the over-edge stitching can be saved.

Still further, according to the cutter drive mechanism of the sewing machine of the present invention, the cutter cutting mechanism portion can be incorporated into the existing space of the sewing machine and hence, it become possible to perform such stitching by changing over an operation which performs the over-edge stitching in the lockstiching by cutting the fabric edge and an operation which performs the lockstitching without cutting the fabric edge.

What is claimed is:

1. A looper drive mechanism for sewing machine in which using an upper thread which is made to pass through a needle which performs an upward and downward movement drawing a trace vertically relative to a throat plate and a lower thread accommodated in a rotary hook, the upper thread which is made to pass through the needle performing the reciprocating movement in the vertical direction and passing through a work mounted on the throat plate every one stitch feed of the work is, at the time of elevating the upper thread from a lowermost position of the needle, intercepted by a loop-taker point of the rotary hook which accommodates the lower thread below the throat plate and performs the rotational movement so as to make the upper thread and the lower thread interlace each other thus forming a lockstitch portion made of a stitch parallel to a surface of the work and a stitch perpendicular to the surface of the work, and an over-edge stitch portion is formed by an upper looper thread and a lower looper thread which are respectively made to pass through an upper looper which performs a reciprocating movement drawing a substantially arcuate trace extending above and below the throat plate and intersects the trace of the needle above the throat plate and a lower looper which draws a substantially arcuate trace below the throat plate and intersects the trace of the needle and the trace of the upper looper respectively, the improvement being characterized in that the looper drive mechanism for sewing machine further includes a looper drive portion having a constitution in which the upper looper and the lower looper are respectively disposed below the throat plate, respective loop-taker points thereof are arranged in the same direction such that the loop-taker points pass a front side of the needle as seen in the stitching direction, the upper looper and the lower looper are driven such that the upper looper and the lower looper perform movements having traces on planes substantially parallel to each other, the upper looper thread which is made to pass through the upper looper which performs the reciprocating movement drawing the arcuate trace which intersects the trace of the needle above the throat plate and passes through the throat plate is intercepted by the needle descending from an uppermost position when the upper looper is descended from an uppermost position, the lower looper thread which is made to pass through the lower looper which performs the reciprocating movement drawing the trace which intersects the trace of the needle and the trace of the upper looper below the throat plate is intercepted by the descending needle below the throat plate when the lower looper is moved from one end to the other end of the trace, and the lower looper thread is intercepted by the upper looper elevating from the lowermost position when the lower looper is moved to the other end, whereby the upper looper thread and the lower looper thread are interlooped each other at the edge portion of the work and, at the same time, the upper looper thread is interlooped with the lockstitch portion through the upper surface of the work, and the lower looper thread is interlooped with the lockstitch portion through the lower surface of the work thus forming the over-edge stitch portion.

2. A looper drive mechanism for sewing machine according to claim 1, wherein the looper drive portion includes a crank which is mounted on a looper drive shaft driven by a lower drive shaft, a lower looper drive link which is connected to the crank, a lower looper mounting arm for carrying the lower looper which is connected to the lower looper drive link and journalled in a frame, an upper looper mounting arm for carrying the upper looper which is journalled in the frame, and an upper looper drive link which connects the lower looper drive link and the upper looper mounting arm.

3. A looper drive mechanism for sewing machine according to claim 2, wherein the looper drive mechanism includes a clutch which forms the lockstitch portion and the over-edge portion by transmitting power from the lower shaft to the looper drive shaft at the time of forming the over-edge portion, and forms the lockstitch portion by shunting the upper looper at the lowermost position and interrupting the transmission of power from the lower shaft to the looper drive shaft at the time of forming the lockstitch portion.

4. A cutter drive mechanism of sewing machine for cutting a fabric edge by an upper cutter which performs upward and downward movement by way of a motion transfer mechanism which is operated in an interlocking manner with a rotary shaft of the sewing machine and a lower cutter which is cooperatively operated with the upper cutter, the improvement being characterized in that the cutter drive mechanism of sewing machine includes a cutter drive portion pivotally mounted on a frame and slidably guides the upper cutter, and the motion transfer mechanism is connected to the upper cutter such that by way of a clutch which allows the transmission of power to the upper cutter when the cutter operation of the cutter drive portion is performed and interrupts the transmission of power to the upper cutter by pivotally moving the cutter drive portion to a shunting position when the cutter operation of the cutter drive portion is not performed.

5. A cutter drive mechanism of sewing machine according to claim 4, wherein said motion transfer mechanism includes a first quadric crank chain which connects an upper shaft constituting the rotary shaft and the frame and a second quadric crank chain which uses one link of the first quadric crank chain and a link joint of the frame and adopts a drive portion of the clutch as the other one link.

6. A cutter drive mechanism of sewing machine according to claim 5, wherein the clutch includes a pin which is formed on the other one link as a drive portion and an elongated groove formed in the upper cutter for allowing the pin to be fitted thereinto as a driven portion.

7. A cutter drive mechanism of sewing machine according to claim 4, wherein the lower cutter is slidably mounted on the cutter drive portion and the lower cutter includes a locating locking-portion which positions the cutter drive portion at a locating recessed-portion of a throat plate relative to a needle stitching point when the cutter is operated.

8. A cutter drive mechanism of sewing machine according to claim 7, wherein the locating recessed-position of the throat plate is constituted position-adjustably in the rightward and leftward direction such that the stitch width can be changed relative to the needle stitching point.

9. A cutter drive mechanism of sewing machine according to claim 4, wherein the lower cutter is slidably mounted on the cutter drive portion and the cutter drive mechanism of sewing machine further includes a cutter-side pressure spring member which biases the upper cutter to the lower cutter.

10. A cutter drive mechanism of sewing machine according to claim 4, wherein the lower cutter is slidably mounted on the cutter drive portion and the cutter drive mechanism of sewing machine further includes a locating spring member which biases the locating locking-portion to the locating recessed-portion of the throat plate at the time of performing the cutting operation.

11. A cutter drive mechanism of sewing machine according to claim 4, wherein the lower cutter is slidably mounted on the cutter drive portion and the cutter drive mechanism of sewing machine further includes a locating eccentric cam which fits the locating locking-portion into the locating recessed-portion of the throat plate at the time of performing the cutting operation.

12. A cutter drive mechanism of sewing machine according to claim 4, wherein the upper cutter is replaceably mounted on the cutter drive portion.

13. A cutter drive mechanism of sewing machine according to claim 4, wherein the lower cutter is slidably mounted on the cutter drive portion and includes a locating locking-portion which locates the cutter drive portion at the locating recessed-portion of the throat plate relative to the needle stitching position, and the cutter drive portion includes a locating lever which fits the locating locking-portion into the locating recessed-portion of the throat plate at the time of performing the cutter operation.

* * * * *